US012181188B2

(12) United States Patent
Kim et al.

(10) Patent No.: US 12,181,188 B2
(45) Date of Patent: Dec. 31, 2024

(54) REFRIGERATOR FOR DRINKS

(71) Applicant: LG ELECTRONICS INC., Seoul (KR)

(72) Inventors: Dae Woong Kim, Seoul (KR); Hee Su Yang, Seoul (KR); Min Kyu Oh, Seoul (KR); Su Young Lee, Seoul (KR); Ja Yoen Kim, Seoul (KR); Hwa Yun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 44 days.

(21) Appl. No.: 17/193,735

(22) Filed: Mar. 5, 2021

(65) Prior Publication Data

US 2021/0278111 A1 Sep. 9, 2021

(30) Foreign Application Priority Data

Mar. 6, 2020 (KR) ..... 10-2020-0028202
Mar. 6, 2020 (KR) ..... 10-2020-0028203
Aug. 25, 2020 (KR) ..... 10-2020-0107237
Oct. 27, 2020 (KR) ..... 10-2020-0140489

(51) Int. Cl.
*F25B 21/04* (2006.01)
*F25D 31/00* (2006.01)

(52) U.S. Cl.
CPC ..... *F25B 21/04* (2013.01); *F25D 31/002* (2013.01)

(58) Field of Classification Search
CPC ..... F25B 21/04; F25D 31/002; B67D 2210/00031
See application file for complete search history.

(56) References Cited

U.S. PATENT DOCUMENTS 2,513,610 A * 7/1950 Williams ..... F25D 31/002 62/392
2004/0154311 A1 8/2004 Luzaich et al.
2010/0005811 A1 1/2010 Jaffe et al.
2015/0225222 A1 8/2015 Jaffe et al.
2016/0280529 A1* 9/2016 Venezia ..... B67D 3/0006
(Continued)

FOREIGN PATENT DOCUMENTS

CN 101772461 A 7/2010
CN 103459950 A 12/2013
CN 104807281 A 7/2015
(Continued)

OTHER PUBLICATIONS

Kim, A Wine Dispenser, Jan. 9, 2012, (KR20120002672A), English Translation, Whole Document (Year: 2012).*
(Continued)

*Primary Examiner* — Larry L Furdge
*Assistant Examiner* — Keith Stanley Myers
(74) *Attorney, Agent, or Firm* — Birch, Stewart, Kolasch & Birch, LLP

(57) ABSTRACT

A refrigerator for drinks is provided. The refrigerator has an open hole that is open upward to allow a drink container to be inserted in an erect state in a cabinet through the open hole. An insertion guide connected to the open hole is disposed in the cabinet and the width of the insertion guide changes in a height direction. Accordingly, a drink container is guided by the insertion guide when being inserted into or taken out of the refrigerator for drinks.

18 Claims, 19 Drawing Sheets

(56) References Cited

U.S. PATENT DOCUMENTS

| | | | | |
|---|---|---|---|---|
| 2018/0313583 | A1* | 11/2018 | Kawasaki | F25D 31/007 |
| 2019/0335921 | A1* | 11/2019 | Jakobsen | A47F 3/0434 |

FOREIGN PATENT DOCUMENTS

| | | | | | |
|---|---|---|---|---|---|
| JP | 11-334796 | A | | 12/1999 | |
| KR | 20120002672 | A | * | 1/2012 | B67D 1/04 |
| KR | 10-1174393 | B1 | | 8/2012 | |

OTHER PUBLICATIONS

Porter, Overview of Design for Manufacturing and Assembly (DFMA), https://edisciplinas.usp.br/mod/resource/view.php?id=1578127, Whole Document (Year: 2020).*

* cited by examiner

REFRIGERATOR FOR DRINKS

CROSS REFERENCE TO RELATED APPLICATIONS

The present application claims priority to Korean Patent Application No. 10-2020-0028202, filed on Mar. 6, 2020, Korean Patent Application No. 10-2020-0028203, filed on Mar. 6, 2020, Korean Patent Application No. 10-2020-0107237, filed on Aug. 25, 2020, and Korean Patent Application No. 10-2020-0140489, filed on Oct. 27, 2020, the entire contents of which are incorporated herein by reference.

BACKGROUND OF THE INVENTION

Field of the Invention

The present disclosure relates to a refrigerator for drinks and, more particularly, to a refrigerator for drinks designed to cool a drink in a bottle.

Description of the Related Art

In general, a refrigerator is a home appliance that can keep food at a low temperature in a storage space that is closed by a door. To this end, a refrigerator is configured to keep stored food in an optimal state by cooling the inside of the storage space using cold air that is generated by exchanging heat with a refrigerant circulating in a refrigeration cycle.

Recently, the function of refrigerators is increasingly varied with the tendency of a change of dietary life and an increase in quality of the products, and refrigerators having various structures and convenient equipment to enable users to conveniently use the refrigerator and efficiently use the internal space are coming into the market. In particular, as consumption and preference for alcohols such as wine and champagne increase, refrigerators suitable for keeping alcohols in accordance with the kinds of alcohols and refrigerators for keeping ripe food such as Kimchi, etc. have been developed.

According to such wine refrigerators of the related art, a user can open the door at the front surface and put wines into the refrigerators and then can take out and drink a wine, if necessary. However, when the door is opened, warm air flows into the storage compartment of the refrigerator and increases temperature therein. Accordingly, the cooling efficiency of the wine refrigerators decreases.

In order to make up for this defect of the wine refrigerators in the related art, a dispenser type wine refrigerator that can dispense wine without taking out a wine bottle has been developed. Wine refrigerators having a cooler therein and a dispenser for dispensing wine have been disclosed in Korean Patent No. 10-1174393 (prior art 1) and U.S. Patent Application Publication No. U.S. Pat. No. 20150225222A1 (prior art 2).

Such dispenser type wine refrigerators have a structure in which a door forming the front surface is opened forward. Accordingly, it is required to prevent interference between the door and a dispenser nozzle when the door is opened and closed, so the dispenser nozzle is positioned higher than the door. Accordingly, the height of the entire refrigerator is increased at least as much as the height of the nozzle, so the volume is increased or a user has to keep wine bottles at an angle in the storage compartment, which deteriorates usability.

Further, when the door forming the front surface is opened, warm external air flows into the storage compartment through the wide front surface, so the cooling efficiency of the wine refrigerator is deteriorated.

In order to solve these problems, a door is disposed on the top of a refrigerator such that drink containers are kept in an erect state in a storage compartment, but in this case, the inlet of the door is relatively narrowed, so it is not easy to put in and take out drink containers.

On the other hand, users can check the kinds of drinks such as wine in a refrigerator through a transparent door, but it is required to install parts such as hinges and handles for opening and closing the door. There is limitation in increasing the size of a transparent glass at the center of the door due to the parts such as hinges, which decreases the aesthetic appearance.

PRIOR ART DOCUMENT

[Patent Document]

[Patent Document 1] Korean Patent No. 10-1174393

[Patent Document 2] U.S. Patent Application Publication No. U.S. Pat. No. 20150225222A1

SUMMARY OF THE INVENTION

The present disclosure has been made in an effort to solve the problems of the related art and an objective of the present disclosure is to make it possible to dispense a drink through a nozzle without taking out a drink container from a refrigerator for drinks and to enable a drink container to be kept in an erect state through a door on the top.

Another objective of the present disclosure is to enable a drink container to be easily put in and discharged by providing an insertion guide for storing/discharging a drink container.

Another objective of the present disclosure is to enable a drink container to be guided to a cooling guide of a refrigerator for drinks along an insertion guide.

Another objective of the present disclosure is to enable a drink container to be guided to a cooling guide along an insertion guide even if the center of an inlet for receiving/discharging a drink container and the center of an internal cooling guide are not aligned.

Another objective of the present disclosure is to make it possible to keep a drink container in a storage compartment or take out the drink container from the storage compartment with the inlet of the drink container fixed by a cover assembly and is to enable the cover assembly to function as an internal door closing the storage compartment.

Another objective of the present disclosure is to configure the front surface of a refrigerator for drinks using an insulating panel having a continuous outer surface and to connect a nozzle to the insulating panel.

Another objective of the present disclosure is to enable drink containers to be kept in an erect state in a refrigerator for drinks and enable drink containers with various sizes to be fixed with a predetermined height using a simple fixing structure.

In order to achieve the objectives, according to an aspect of the present disclosure, a refrigerator of the present disclosure may have an open hole that is open upward, so a drink container may be inserted in an erect state in a cabinet through the open hole. An insertion guide connected to the open hole may be disposed in the cabinet and the width of the insertion guide may change in a height direction.

Accordingly, a drink container may be guided by the insertion guide when being inserted into or taken out of the refrigerator for drinks.

In particular, the width of the insertion guide gradually increases toward the open hole in at least a partial section in the height direction of the insertion guide. Accordingly, a drink container may be more easily stored and taken out.

The insertion guide may guide the drink container inserted through the open hole toward a front panel. Accordingly, when a drink container is inserted into the refrigerator, the insertion guide may guide the drink container toward the front panel. When the drink container is moved toward the front panel, the drink container may be displayed to be larger through the front panel (insulating panel) that is transparent.

An inner case disposed in the cabinet may include sides, a bottom connected to the sides, and the insertion guide connected to the open hole. A cooling guide may be coupled between the bottom and the insertion guide.

The insertion guide may have an expansion, and the expansion may be inclined such that an inlet of the insertion guide in which the drink container is inserted widens. The expansion may guide a drink container that is inserted and taken out.

The front of the insertion guide and the inner surface of the cabinet may be spaced apart from each other, so a mount space may be formed, and a display or an operation panel may be disposed in the mount space.

The insertion guide may surround a portion around the inlet of the drink container and the outside of the insertion guide may be filled with an insulating portion. Accordingly, the insertion guide may increase the insulating performance around the inlet of the drink container.

An inner case connected with the open hole may be disposed in the cabinet in the refrigerator for drinks of the present disclosure, and the inner case may be formed such that the width increases toward the open hole. Accordingly, a drink container may be guided by inner case when being inserted into or taken out of the refrigerator for drinks.

A cooling guide may be disposed in the cabinet in the refrigerator for drinks of the present disclosure, and the insertion guide may connect the open hole and the cooling guide to each other. Accordingly, a drink container may be guided by the insertion guide when being inserted into or taken out of the refrigerator for drinks.

The insertion guide may be disposed in the cabinet and may connect the open hole and the cooling guide to each other, in which the center of the inlet connected to the open hole may be deviated from the center of a horizontal cross-sectional surface of the cooling guide. Accordingly, even if the center of the storage compartment in which a drink container is stored and the center of the inlet for inserting/taking out the drink container are not aligned, the drink container may be inserted into or taken out of the refrigerator along the insertion guide.

A dispenser nozzle may be disposed on the cabinet, so the drink in the drink container may be supplied to the outside, and a door may cover the top of the cabinet including the open hole. A connection pipe having a height overlapping the insertion guide may be disposed in the dispenser nozzle and may be connected to the inside of the cabinet. Accordingly, the dispenser nozzle may not be interfered with by the door that is opened and closed, and the height of the entire refrigerator may be increased.

The open hole may be positioned on the top of the cabinet, so the open hole may be an inlet for inserting/taking out a drink container. As described above, since an inlet for inserting/taking out a drink container may be formed at the upper portion of the refrigerator, inflow of external air may be prevented and leakage of coldness from the refrigerator to the outside may be reduced.

In particular, the open hole may be an only inlet of the storage compartment, and the width of the open hole (entrance) may be small, so a loss of heat due to leakage of coldness may be further decreased.

A cover assembly may be coupled to the cabinet, at least a portion of the cover assembly may surround and fix the inlet of the drink container, and the cover assembly may close the open hole, thereby being able to close the inlet of the storage compartment in which the drink container is stored. Accordingly, the cover assembly itself may function as a kind of internal door and may function as a kind of handle fixing a drink container.

At least a portion of the dispenser nozzle may have a height overlapping the mount space of the cabinet in which a display or an operation panel is disposed. Accordingly, there is no need for providing the refrigerator with a specific height section for installing the dispenser nozzle.

An inner case may be disposed in the cabinet. The inner case may include an inner frame connected to the open hole and a cooling guide coupled to the inner frame. The cooler may be disposed behind the cooling guide.

A door forming a top of the cabinet may be rotatably coupled to an upper portion of the cabinet, and when the door covers the upper portion of the cabinet, the door may close the cover assembly. The door may increase the insulating effect by doubly covering the cover assembly and the storage compartment.

Several storage compartments may be formed inside the inner case and several dispenser nozzles may be connected to the storage compartments, respectively, so a user may take out a drink from a desired storage compartment.

The refrigerator for drinks according to the present disclosure has the following effects.

The refrigerator of the present disclosure may have an open hole that is open upward, so a drink container may be inserted in an erect state in a cabinet through the open hole. Accordingly, since a drink container may pass through the open hole to be erect, so the open hole may be formed to be slightly smaller than the width (diameter) of the drink container. As described above, since the open hole is narrow in the present disclosure, there is an effect of reducing leakage of coldness or a loss of heat due to inflow of external air.

Since the entrance for inserting and taking out a drink container may be formed at the top of the refrigerator in the present disclosure, even if a dispenser nozzle is installed on the front surface of a side of the refrigerator, the dispenser nozzle may not interfere with the entrance and the door. Accordingly, it may not be required to install the dispenser nozzle on the top of the refrigerator to avoid the door that is opened forward, and it may be possible to reduce the height of the entire refrigerator at least by the height of the dispenser nozzle, whereby the size of the refrigerator may be reduced.

Since the insertion guide may be connected to the open hole that is an entrance for inserting and taking out a drink container in the present disclosure, the drink container may be guided when it is inserted into or taken out of the storage compartment. In particular, the width of the insertion guide may gradually increase toward the open hole. Accordingly, a drink container may be more easily stored and taken out.

The insertion guide may have an expansion, and the expansion may be inclined such that an inlet of the insertion guide in which the drink container is inserted widens. The expansion may widen the inlet of the open hole and may enable a drink container to be moved toward the center of the storage compartment, so the refrigerator for drinks may be more conveniently used.

Accordingly, when a drink container is inserted into the refrigerator, the insertion guide may guide the drink container forward, that is, toward the front panel. When the drink container is moved toward the front panel, the drink container may be displayed to be larger through the front panel (insulating panel) that is transparent, so the aesthetic appearance provided by the refrigerator may be improved. Further, an empty space is naturally increased behind the drink container, so a space in which the cooler may be disposed may be easily secured.

A cooling guide may be disposed in the cabinet in the refrigerator for drinks of the present disclosure, and the insertion guide may connect the open hole and the cooling guide to each other. Accordingly, a drink container may be guided by the insertion guide when being inserted into or taken out of the refrigerator for drinks. Since the insertion guide may guide a drink container that is inserted, so it may be a part that has low direct relevance with cooling. Accordingly, the insertion guide may be made of synthetic resin in various shapes and may be easily manufactured.

The center of the inlet connected to the open hole may be deviated from the center of a horizontal cross-sectional surface of the cooling guide, and the insertion guide may connect the open hole that is an entrance and the cooling guide to each other. Accordingly, even if the center of the storage compartment in which a drink container is stored and the center of the inlet for inserting/taking out the drink container are not aligned, the drink container may be inserted into or taken out of the refrigerator along the insertion guide. Accordingly, the cooling guide may be installed at more various positions in the refrigerator for drinks and the refrigerator for drinks may be more freely designed.

The insertion guide may surround a portion around the inlet of the drink container and the outside of the insertion guide may be filled with an insulating portion. Accordingly, insulating performance may be increased at the inlet of a drink container surrounded by the insertion guide.

In the present disclosure, the dispenser nozzle may protrude outward and the drink in a drink container in the storage compartment may be dispensed through the dispenser nozzle. A user may be supplied with a drink through the dispenser nozzle even without taking out a drink container from the refrigerator for drinks and a loss of heat that may be generated when a door is opened to take out a drink container may be prevented, so the cooling efficiency of the refrigerator may be improved.

Since a door may be disposed on the front surface of the refrigerator, an insulating panel constituting the front surface may be configured as a single part that is not separated and a dispenser nozzle may be disposed on the insulating panel. Accordingly, the front surface of the refrigerator that is the most exposed to a user may provide a uniform aesthetic appearance.

Since a door may be not installed on the front surface of the refrigerator for drinks in the present disclosure, it may be possible to apply an insulating panel to the entire front surface without parts such as a gasket and a hinge. Further, when the insulating panel is made of a transparent material, the area through which the inside of the storage compartment can be seen may be increased. Accordingly, there is an effect that the front design of the refrigerator that is exposed most to a user may be aesthetic.

A connection pipe having a height overlapping the insertion guide of the inner case may be disposed in the dispenser nozzle and may be connected to the inside of the cabinet in the present disclosure. The insertion guide may guide a drink container that is inserted, so it may be a part that has low direct relevance with cooling. Accordingly, when the connection pipe connecting the dispenser nozzle and the inside of the cabinet to each other may have a height overlapping the insertion guide, leakage of coldness through the connection pipe may be minimized.

In the present disclosure, a drink container is fitted in the cover assembly when it is stored, so the cover assembly itself may function as a kind of internal door by closing the entrance of the storage compartment. Accordingly, since the cover assembly may close the storage compartment together with the door, the entrance may be doubly insulated, whereby the insulating effect may be improved.

According to the present disclosure, it may be possible to take out a drink container fitted in a cover assembly from the storage compartment or put the drink container into the storage compartment. Since the cover assembly may function as a kind of handle, it may be easy to take out and put in a drink container.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION OF THE INVENTION

Figure 1:
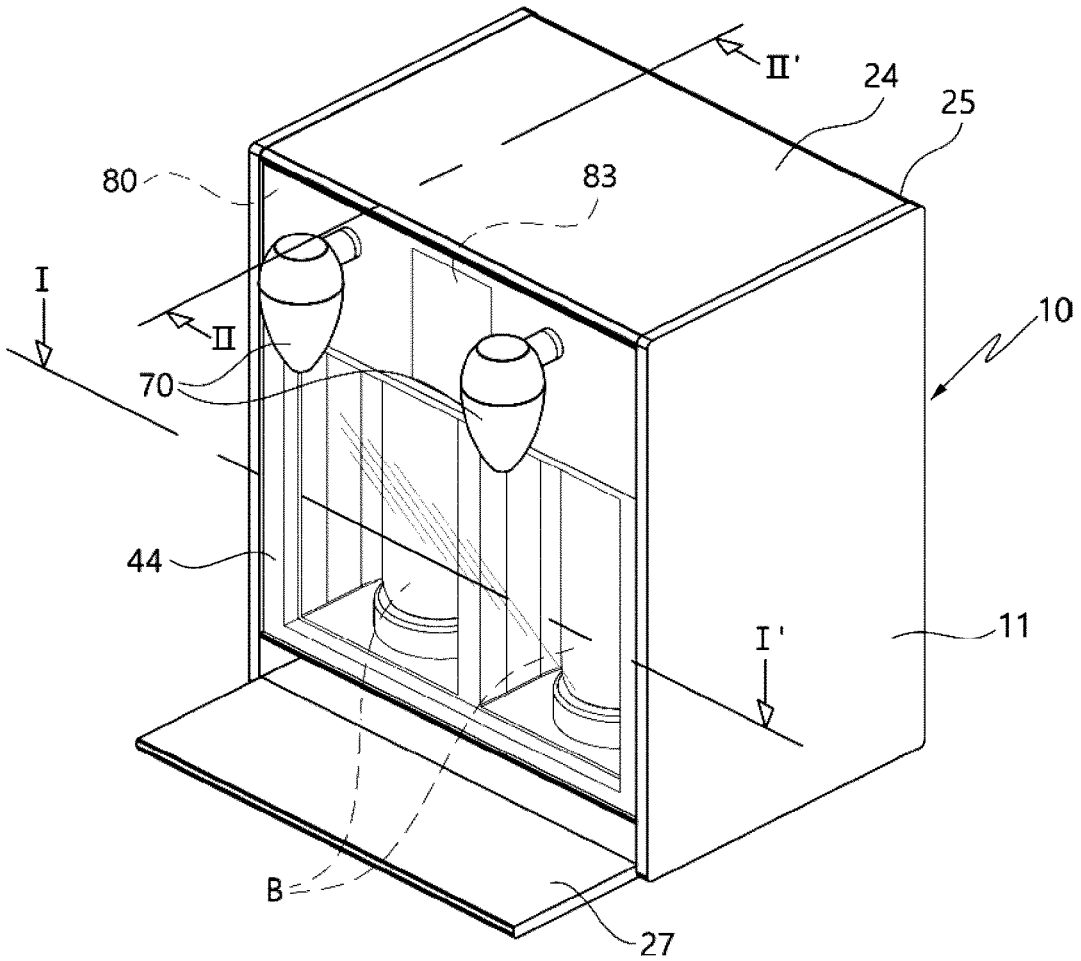
FIG. 1 is a perspective view showing the configuration of an embodiment of a refrigerator for drinks according to the present disclosure.

Hereinafter, some embodiments of the present invention are described in detail with exemplary drawings. It should be noted that when components are given reference numerals in the drawings, the same components are given the same reference numerals even if they are shown in different drawings. In the following description of embodiments of the present disclosure, when detailed description of well-known configurations or functions is determined as interfering with understanding of the embodiments of the present disclosure, they are not described in detail.

Terms "first", "second", "A", "B", "(a)", and "(b)" can be used in the following description of the components of embodiments of the present disclosure. These terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

A refrigerator for drinks (hereafter, referred to as a 'refrigerator') of the present disclosure is described with reference to an embodiment. For reference, a refrigerator for keeping a drink container B that is vertically long such as a wine bottle is exemplified below, but the present disclosure may be applied to a refrigerator that may cool various drinks in bottles other than wine bottles.

Figure 2:
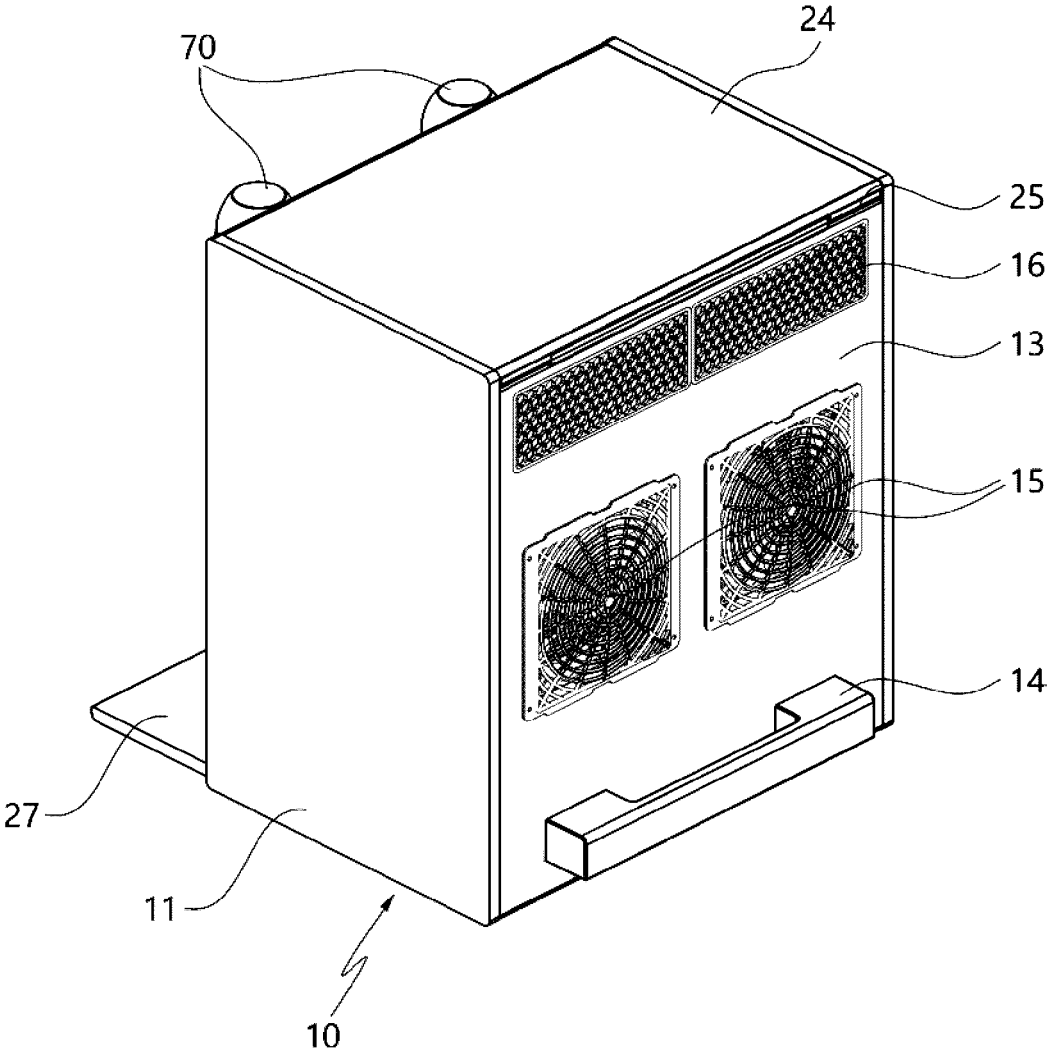
FIG. 2 is a perspective view showing the configuration of the rear surface of an embodiment of a refrigerator for drinks according to the present disclosure.

Referring to FIGS. 1 and 2, a cabinet 10, which forms the external appearance of a refrigerator, as shown in the figures, is formed such that the front-rear width is relatively short. As described above, the refrigerator according to the embodiment may have a small bottom area, so there is no need for a large installation area. Accordingly, the refrigerator may be placed on the floor or may be installed on a table.

Figure 3:
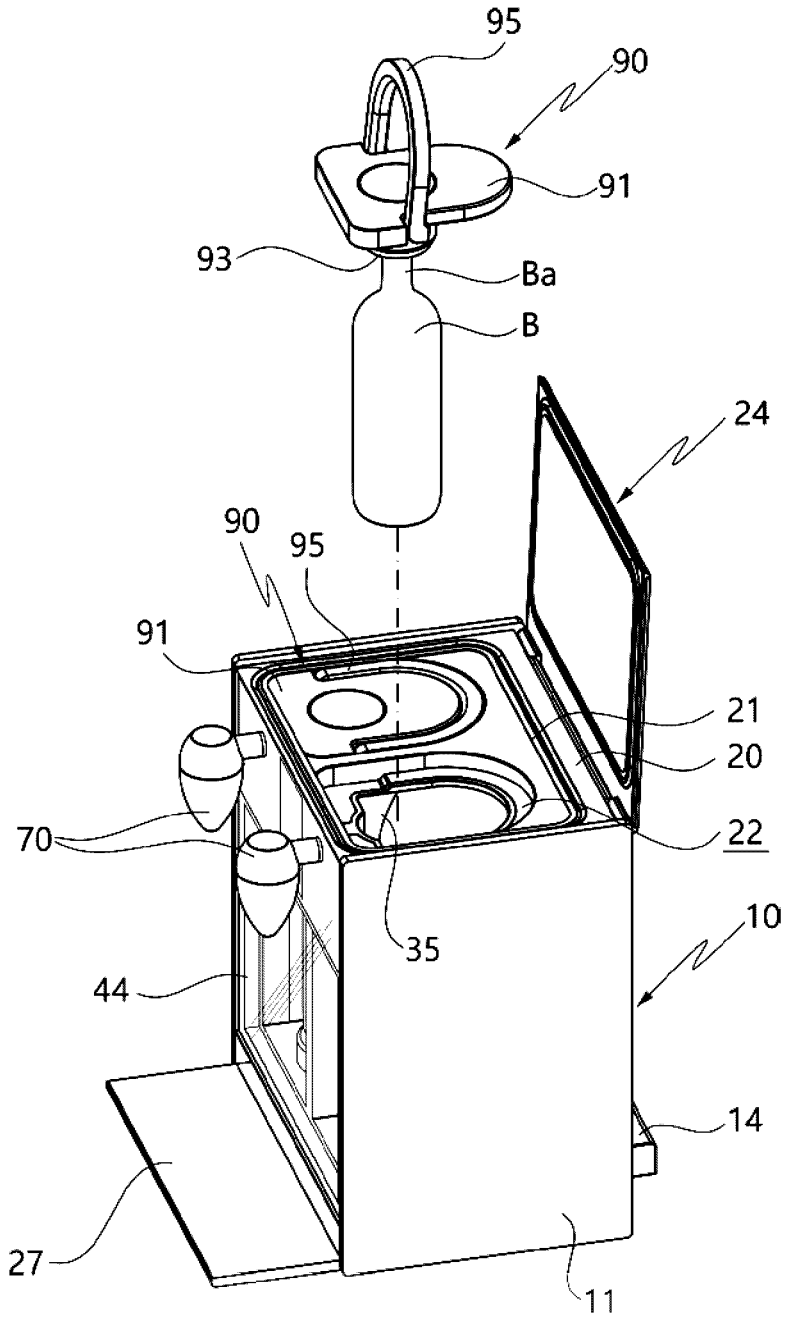
FIG. 3 is a perspective view showing the state in which a drink container has been taken out in an embodiment of the present disclosure.

In the embodiment, the cabinet 10 may have a substantially hexahedron shape and may have an installation space S (see FIG. 16), and an inner case 30, 40 and a cooler C to be described below may be installed in the installation space S. A storage compartment 32 may be formed inside the inner case 30, 40 and the drink container B may be stored in the storage compartment 32. For reference, the state in which the drink container B fitted in a cover assembly 90 has been taken out of the storage compartment 32 is shown in FIG. 3.

The installation space S is the entire internal space of the cabinet 10 and the storage compartment is the space defined inside the inner case 30, 40. Accordingly, it may be possible to consider that the storage compartment 32 is formed in the installation space S. The storage compartment 32, which is a space in which a drink container B is stored, is a space formed by combining several parts including a cooling guide 40 to be described below.

Figure 4:
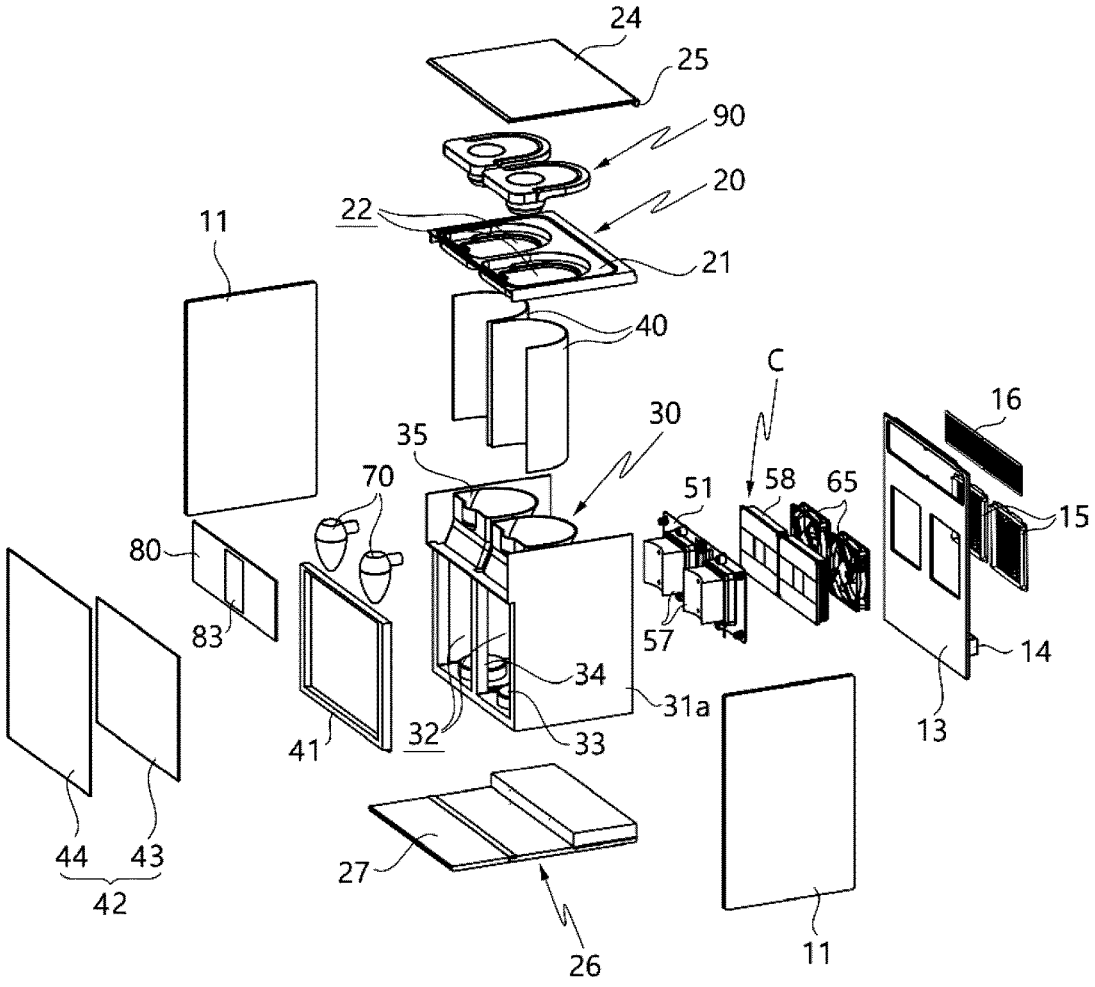
FIG. 4 is an exploded perspective view showing parts of an embodiment of the present disclosure.

Referring to FIG. 4, the state in which the parts of the cabinet 10 have been disassembled is shown in FIG. 4. The cabinet 10 may include a pair of side plates 11, a rear plate 13, an upper cover 20, and a lower cover 26. The pair of side plates 11, the rear plate 13, the upper cover 20, and the lower cover 26 may be assembled, thereby forming the installation space S therein and forming the external appearance of the refrigerator. An insulating panel 42 to be described above may be disposed on the front surface of the cabinet 10, which will be described below.

As for the rear plate 13 of the cabinet 10, an air intake port and an air discharge port may be formed in the rear plate 13. The air intake port may be a part through which external air is taken inside and the air discharge port may be a part through which the air in the refrigerator is discharged outside. In this embodiment, the air intake port may be formed at an intake grille 15 coupled to the rear plate 13 and the air discharge port may be formed at a discharge grille 16 coupled to the rear plate 13. Obviously, the air intake port and the air discharge port may be directly formed at the rear plate 13 without the intake grille 15 and the discharge grille 16.

The rear plate 13 may have a spacer 14. The spacer 14 may protrude outward, that is, away from the installation space S of the refrigerator from the rear plate 13. The spacer 14, which is provided to keep a distance between the rear plate 13 and the wall of an installation place where the refrigerator is installed, may be elongated to the left and right, as shown in FIG. 2. The spacer 14 may naturally form an air flow space between the rear plate 13 and the wall of an installation place. The spacer 14 may function as a kind of handle. That is, a user may move the refrigerator with the spacer 14 by hand.

Referring to FIG. 4, the upper cover 20 may be disposed over the pair of side plates 11 and the rear plate 13 and may form the top of the installation space S. The upper cover 20 may close other space of the upper portion of the installation space S except for the inlet of the storage compartment 32. In the embodiment, a door 24 of the refrigerator may be disposed on the top of the refrigerator to selectively close the storage compartment 32 and the upper cover 20 may function as a kind of frame on which the door 24 is installed.

An open hole 22 may be formed through the center of the upper cover 20. The open hole 22 may be connected to the inlet of the storage compartment 32 to be described below and may serve to expose the storage compartment 32 to the outside when the door 24 is opened. In FIG. 3, the drink container B has been taken out through the open hole 22. A seal member 21 may be disposed around the open hole 22, and may serve to seal the portion between the top of the upper cover 20 and the door 24 when the door 24 is closed.

Figure 5:
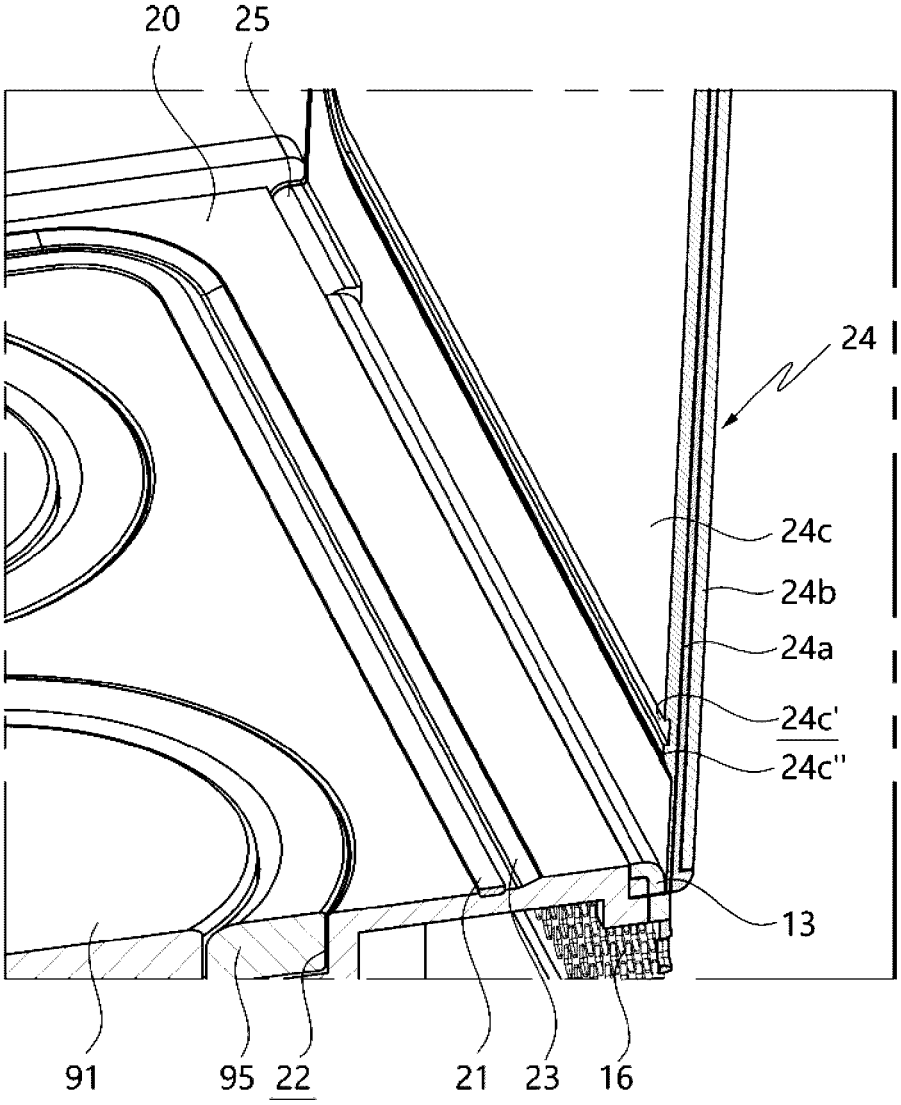
FIG. 5 is a perspective view showing the state in which a door is open in an embodiment of the present disclosure.

Referring to FIG. 5, the seal member 21 may protrude from the surface of the upper cover 20 and a first inclined surface 23 may be formed adjacent to the seal member 21. The first inclined surface 23 may be formed around and outside the seal member 21 and may have a shape of which the height gradually decreases toward the seal member 21. The first inclined surface 23, which may be a part that comes in close contact with a second inclined surface 24*c*" of the door 24 to be described below, may increase the fitting area of the upper cover 20 and the door 24 around the seal member 21.

The door 24 may be disposed on the upper cover 20. The door 24, which is provided to selectively open the open hole 22, may be rotatably coupled to the upper cover 20 through a hinge 25 in the embodiment. The door 24 is closed in FIGS. 1 and 2 and is open in FIG. 3. Alternatively, the door 24 may be coupled to the upper cover 20 in a sliding type or the open hole 22 may be closed only by a cover assembly 90 to be described below without the door 24.

A cross-section of the door 24 is shown in FIG. 5. The door 24 may be formed by combining several flat plates. The door 24 may include a base plate 24*a*, an insulating plate 24*c*, and an outer plate 24*b* in the embodiment. The insulating plate 24*c* and the outer plate 24*b* may be attached to both sides of the base plate 24*a*, respectively.

The base plate 24*a* may be made of various materials such as metal and synthetic resin, and may maintain the basic frame of the door 24. The base plate 24*a* may have an area that may cover the upper cover 20. The hinge 25 may be coupled to the base plate 24*a*, so the door 24 may be rotatably coupled to the cabinet 10.

The outer plate 24*b*, which may be attached to the outer surface of the base plate 24*a*, may have a flat plate structure similar to the base plate 24*a*. The outer plate 24*b* may be exposed upward when the door 24 is closed. Accordingly, the outer plate 24*b* may be made of a material that may improve the aesthetic appearance, and for example, the outer plate 24*b* may be made of wood. Obviously, the outer plate 24*b* may not be provided or may be integrated with the base plate 24*a*.

The insulating plate 24*c* may be attached to the base plate 24*a*. The insulating plate 24*c*, which is a part that faces the upper cover 20 when the door 24 is closed, may have a flat plate structure similar to the base plate 24*a*. The insulating plate 24*c* may be made of an insulating material to achieve insulation by covering the upper cover 20. For example, various insulating materials such as polyurethane resin or aerogel may be applied to the insulating plate 24*c*.

A sealing groove 24*c*' may be formed on the insulating plate 24*c*, so when the door 24 is closed, the seal member 21 on the surface of the upper cover 20 may be inserted in the sealing groove 24*c*'. The second inclined surface 24*c*" may be formed on the insulating plate 24*c* adjacent to the sealing groove 24*c*' and may be brought in close contact with the first inclined surface 23 of the upper cover 20. As described above, when the first inclined surface 23 and the second inclined surface 24*c*" are brought in close contact with each other adjacent to the seal member 21 and the sealing groove 24*c*', the contact area may be increased, so the insulating performance may be improved.

Figure 6:
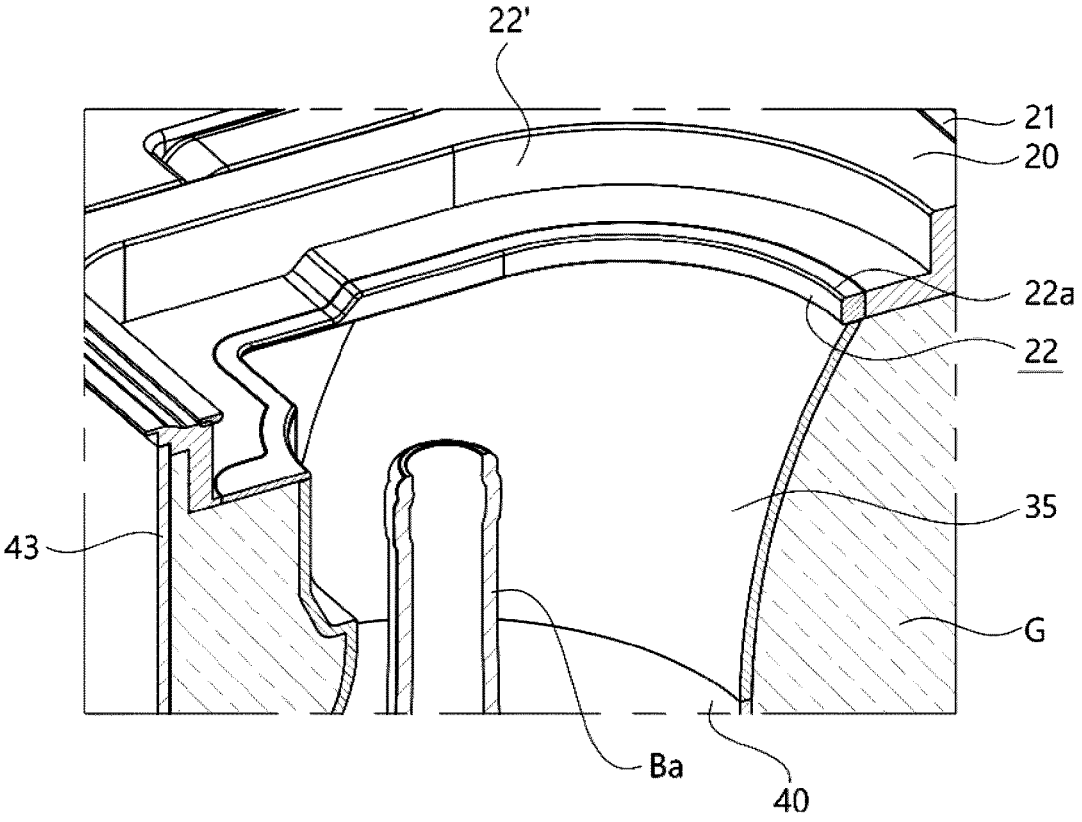
FIG. 6 is a perspective view showing the state in which a door is open and a cover assembly is removed in an embodiment of the present disclosure.
Figure 7:
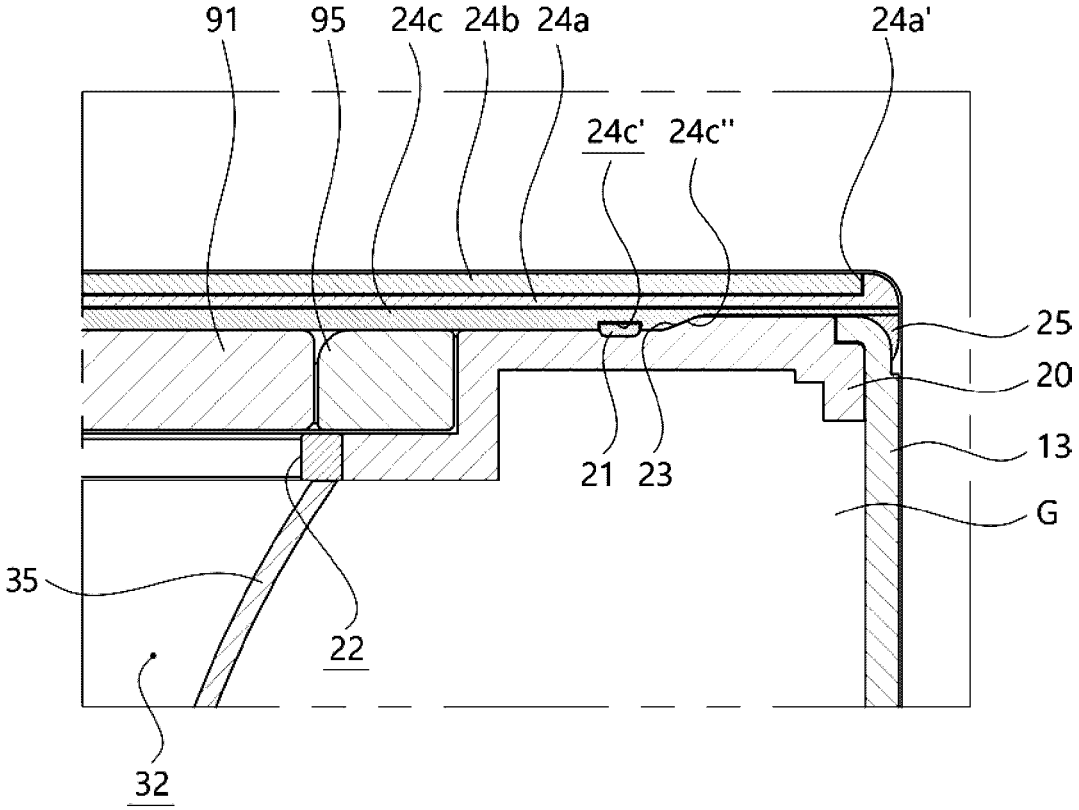
FIG. 7 is an enlarged cross-sectional view showing the surrounding of a door according to an embodiment of the present disclosure.

Meanwhile, referring to FIG. 6, a recessed cover seat 22' may be formed around the open hole 22 of the upper cover 20. When the cover assembly 90 is coupled to the upper cover 20, the cover assembly 90 may fill the cover seat 22'. Accordingly, the surface of the upper cover 20 and the surface of the cover assembly 90 may form flat surfaces at the same height. In FIG. 6, reference numeral '22*a*' indicates an entrance gasket disposed around the edge of the open hole 22, which may prevent leakage of coldness.

Referring to FIG. 4, the lower cover 26 may be disposed at the bottom of the cabinet 10 that is the opposite side to the upper cover 20. The lower cover 26 may form the bottom of the cabinet 10 and may have a flat plate structure. The lower cover 26 may provide a surface on which the refrigerator is installed, and the bottom of the lower cover 26 may be a plane.

The lower cover 26 may have a support plate 27. The support plate 27 may protrude forward from the lower cover 26 and may be considered as a part of the lower cover 26. The support plate 27 may be disposed at a position facing a dispenser nozzle 70 to be described below. Accordingly, when a drink is discharged through the dispenser nozzle 70 with a cup on the support plate 27, the cup may be filled with the drink.

An inner case 30, 40 may be disposed in the cabinet 10. The inner case 30, 40 may be disposed in the installation space S of the cabinet 10 to be surrounded by the cabinet 10. The storage compartment 32 may be formed in the inner case 30, 40 and the drink container B may be stored in the storage compartment 32. The inner case 30, 40 has several storage compartments 32 and the detailed structure thereof will be described below.

Figure 8:
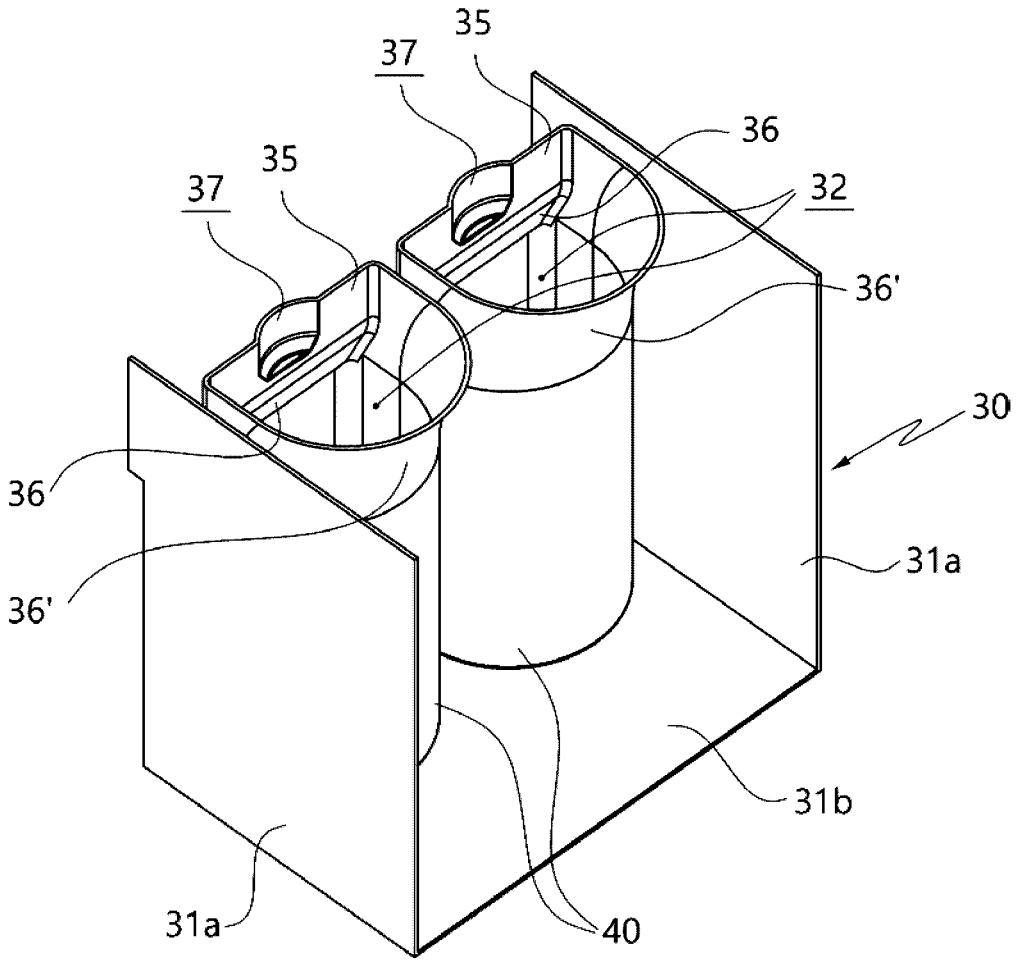
FIG. 8 is a perspective view showing the configuration of an inner case of the embodiment shown in FIG. 4.
Figure 9:
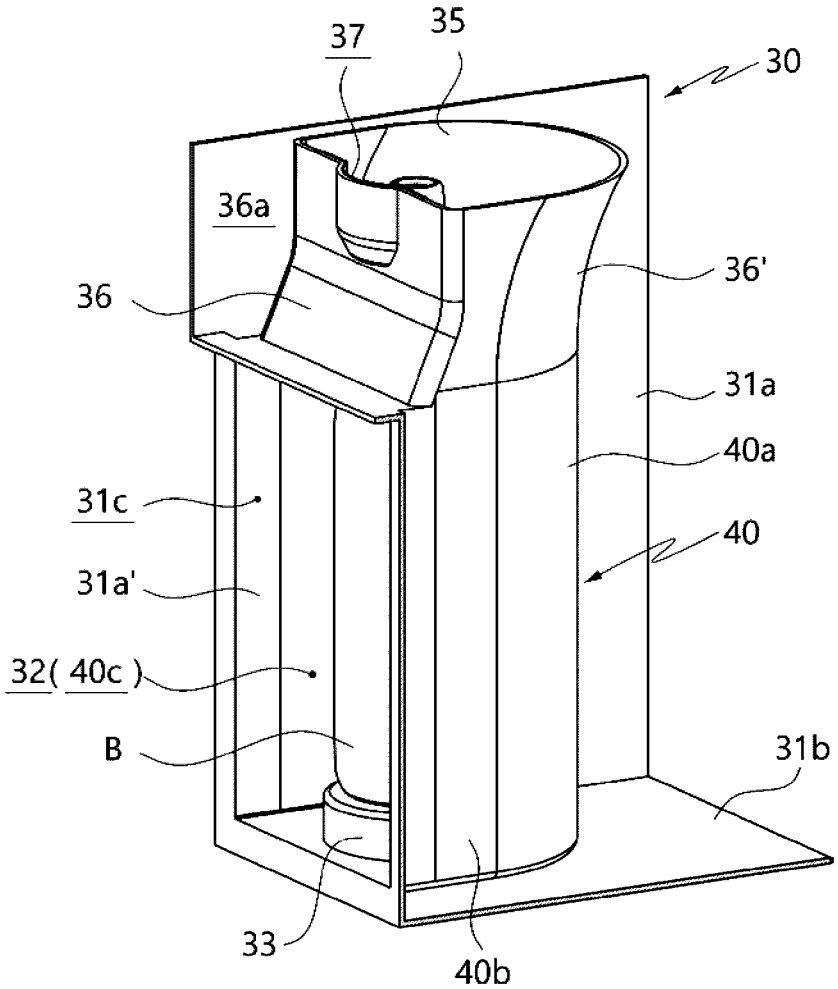
FIG. 9 is a perspective view showing the configuration of the inner case of an embodiment shown in FIG. 4 from an angle different from that in FIG. 8.

The structure of the inner case 30, 40 is shown in detail in FIGS. 4, 8, and 9. The inner case 30.40, 40 may have a three-dimensional structure surrounding the storage compartments 32 with respect the storage compartment 32 at the center. The inner case 30, 40 may have substantially a hexahedron shape in the embodiment, but is not limited thereto. The inner case 30, 40 may be entirely or at least partially made of a nonmetallic material. In the embodiment, the other portion of the inner case 30, 40 excluding a cooling guide 40 combined with the inner case 30, 40 may be made of a nonmetallic material such as synthetic resin.

In more detail, the inner case 30, 40 may include an inner frame 30 and a cooling guide 40. In the embodiment, the inner frame 30 may be made of a nonmetallic material and the cooling guide 40 made of a metallic material may be coupled to the inner frame 30, whereby the inner case 30, 40 may be configured. Accordingly, the inner frame 30 may be formed in a relatively complicated structure in comparison to the cooling guide 40 through injection molding.

Referring to FIGS. 8 and 9, the frame of the inner frame 30 may be formed by a pair of sides 31*a* and a bottom 31*b* connecting the sides 31*a* and forming the floor. A partition wall 34 (see FIGS. 4 and 15) may be disposed between the pair of sides 31*a* and may divide the space between the pair of sides 31*a* into two sections.

A spacing portion 31*a*' is connected to each of the pair of sides 31*a*. The spacing portion 31*a*, which is a portion further protruding toward the front surface of the cabinet 10 from the side 31*a*, is a portion with which the insulating panel 42 to be described below is in close contact. That is, the spacing portion 31*a*' may be considered as being positioned between the cooling guide 40 and the insulating panel 42 to prevent contact between the insulating panel 42 and the cooling guide 40.

As shown in FIG. 9, the front of the side 31*a* may be open, thereby forming an opening 31*c*. The opening 31*c* may be a kind of window being open forward from the inner frame 30 and may be closed by the insulating panel 42. The storage compartment 32 may be positioned inside the opening 31*c* and a cooling space 40*c* surrounded by a cooling guide 40 to be described below may be a portion of the storage compartment 32. For reference, FIG. 9 is a cross-sectional view showing only a portion of the inner case 30, 40 such that the structure of the cooling guide 40 is shown well.

As shown in FIG. 9, a bed 33 may be disposed on the bottom 31*b*. The bed 33 may protrude toward the storage compartment 32 from the bottom 31*b* in a substantially cylindrical shape. The bed 33 may be a part that supports the bottom of the drink container B. Though not shown in the figures, the bed 33 may have an elevation body and the elevation body may be supported by a spring, so the bed 33 may be elastically supported by the spring.

Insertion guides 35 may be disposed inside the inner frame 30 surrounded by the pair of sides 31*a* and the bottom 31*b*. The insertion guide 35 may be connected to the side 31*a* or the bottom 31*b*, but in the embodiment, the insertion guide 35 may be connected to the side 31*a*.

The insertion guide 35 may be spaced upward apart from the bottom 31*b*. The insertion guide 35 may surround at least a portion of the drink container B and it may be considered that a portion of the storage compartment 32 is formed inside the insertion guide 35. In the embodiment, the insertion guide 35 may have a height overlapping the height of the dispenser nozzle 70 to be described below. The insertion guide 35 may surround the inlet Ba of the drink container B.

In the embodiment, the insertion guides 35 may be positioned between the pair of sides 31*a* close to the top of the inner frame 30. The insertion guide 35 may extend in the height direction of the drink container B and may be connected to the cooling guide 40 at the lower end. The cooling guide 40 may be connected to the insertion guide 35 to have a continuous surface and may extend to the bottom 31*b*.

Figure 16:
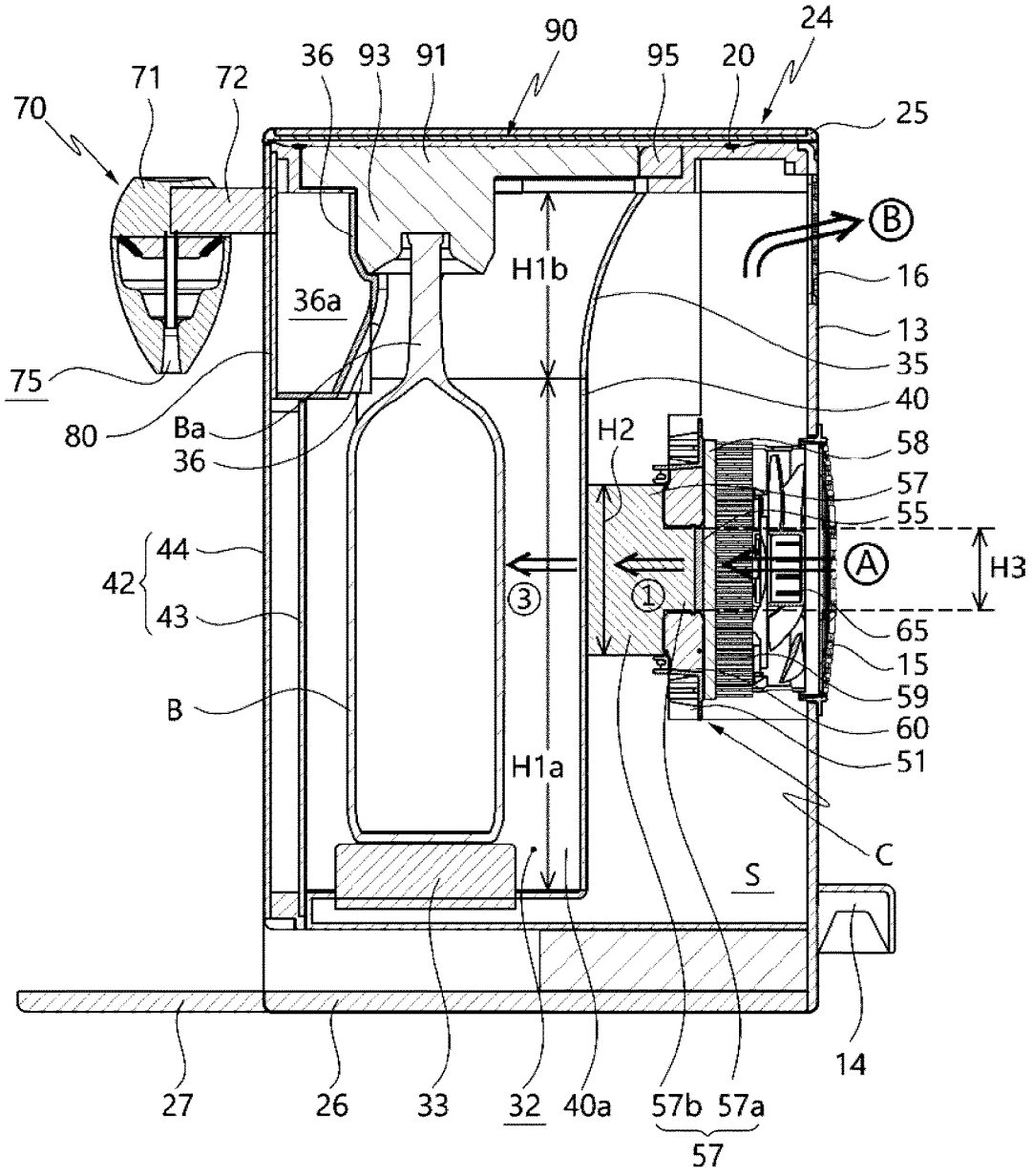
FIG. 16 is a cross-sectional view taken along line II-II' of FIG. 1.

As shown in FIG. 16, the center of the insertion guide 35 connected to the open hole 22 may not be aligned with the center of the horizontal cross-section of the cooling guide 40. In the embodiment, the center of the inlet of the insertion guide 35 may be positioned rearward further than the center of the horizontal cross-section of the cooling guide 40.

Even though the center of the storage compartment 32 for keeping the drink container B and the center of the open hole 22 that is the inlet through which the drink container B is put in and taken out are not aligned, the drink container B may be put in or taken out of the refrigerator along the insertion guide 35. Accordingly, the cooling guide 40 may be disposed at more various positions in the refrigerator for drink containers.

The insertion guide 35 may be several pieces. Two insertion guides 35 may be disposed between the pair of sides 31*a* in the embodiment. A partition wall 34 may be disposed between the pair of insertion guides 35. The partition wall 34 may be a part vertically extending and separating two storage compartments 32. The partition wall 34 may meet the cooling guide 40 to be described below at an end, thereby serving to support the cooling guide 40. That is, the insertion guide 35 may be provided inside the inner frame 30 as many as the number of the cooling guide 40.

Referring to FIG. 9, the front of the insertion guide 35, which faces the front of the cabinet 10, may form the front surface of the insertion guide 35. The front of the insertion guide 35 and the inner surface of the cabinet 10 may be spaced apart from each other, whereby a mount space 36*a* may be formed. The mount space 36*a* may be a portion in which a display 83 (see FIG. 4), etc. may be installed.

The insertion guide 35 may have a shape recessed rearward by the front 36 and it may be considered that the mount space 36*a* is formed by the recessed portion. A portion of the front 36 may be inclined such that the width of the storage compartment 32 decreases upward, that is, toward the upper cover 20. In the embodiment, the lower portion of the front 36 may be an inclined surface inclined rearward and the upper portion thereof may vertically extend.

An extension 36' increasing the inlet of the storage compartment 32 may be formed opposite to the front 36 of the insertion guide 35. The extension 36' may widen the inlet of the storage compartment 32 in the left, right, and rearward directions as the inlet goes up. That is, the extension 36' may be inclined such that the inlet of the storage compartment 32 expands toward the left and right sides 31*a* of the inner frame 30 and away from the insulating panel 42 at the rear.

The extension 36' may guide the drink container B such that the drink container B can be inserted into the center of the storage compartment 32 when the drink container B is inserted into the storage compartment 32. Even if a user does not insert the drink container B right at the center of the storage compartment 32, the drink container B may be moved over the extension 36' and naturally guided to the center of the storage compartment 32.

In more detail, the expansion 36' of the insertion guide 35 may guide the drink container B forward, that is, toward the forward panel when the drink container B is inserted into the storage compartment 32. The front panel may be the insulating panel 42 to be described below. When the drink container B is moved toward the front panel, the drink container may be shown larger forward through the transparent front panel. Accordingly, the effect of displaying the drink container B may be increased in the embodiment.

Further, as the drink container B is guided forward, that is, toward the front panel, the empty space behind the drink container B may naturally increase. The cooler C to be described below may be installed in the empty space secured in this way. That is, the installation space S in which the cooler C may be installed may be sufficiently secured behind the drink container B, which may be an environment that is advantageous in terms of heat dissipation from the cooler C.

As described above, since the expansion 36' may extend to widen the inlet of the storage compartment 32, but the front 36 is recessed toward the rear of the cabinet 10, the front 36 may somewhat reduce the width of the upper portion of the storage compartment 32. Accordingly, the volume of the storage compartment 32 may also decrease, so the storage compartment 32 may be more effectively cooled. The outer side, that is, the opposite side to the storage compartment 32 of the expansion 36' may be filled with an insulating portion G. This is clearly shown in FIG. 15. On the other hand, the insertion guide 35 may be formed with a uniform width without the expansion 36'.

Referring to FIG. 8, the insertion guide 35 may have a seat groove 37. The seat groove 37 may be formed at the inlet of the insertion guide 35 and may be recessed in a direction in which the inlet of the insertion guide 35 is expanded. The seat groove 37 may be formed substantially in an arc shape and a portion of the cover assembly 90 to be described below may be fitted in the seat groove 37. The shape of the seat groove 37 may be changed to fit to the shape of the cover assembly 90.

The cooling guide 40 may be coupled to the inner frame 30. The cooling guide 40 may be coupled to the lower portion of the insertion guide 35, thereby being a part of the inner case 30, 40. When the cooling guide 40 is coupled to the insertion guide 35, the storage compartment 32 may be formed inside. Although the cooling guide 40 is separated from the inner frame 30 in FIG. 4, the cooling guide 40 has been coupled to the lower portion of the insertion guide 35 of the inner frame 30 in FIG. 8.

When the cooling guide 40 is coupled to the insertion guide 35, the cooling guide 40 and the insertion guide 35 may be continuously connected. Accordingly, the storage compartment 32 may be formed as one space by the insertion guide 35 and the cooling guide 40. In the embodiment, if the insertion guide 35 surrounds the inlet Ba, that is, the upper portion of the drink container B, it may be considered that the cooling guide 40 surrounds the main body of the drink container B.

In more detail, the insertion guide 35 and the cooling guide 40 may form a portion of the storage compartment 32. The other portion of the storage compartment 32 may be closed by the bottom 31*b*, and the insulating panel 42 and the cover assembly 90 to be described below. As a result, the storage compartment 32 may be considered as a closed space defined by the inner case 30, 40 including the cooling guide 40, and the cabinet 10.

The cooling guide 40 may be configured to surround at least a portion of the storage compartment 32 and may serve to reduce the temperature of the storage compartment 32. The cooling guide 40 may be controlled in temperature by being directly connected to the cooler C to be described below. For example, when the temperature of the cooling guide 40 is decreased by operation of the cooler C, the temperature of the storage compartment 32 that is the space inside the cooling guide 40 also decreases.

To this end, the cooling guide 40 may be made of a material with high thermal conductivity. In the embodiment, the cooling guide 40 may be made of aluminum. Alternatively, the cooling guide may be made of various materials such as an aluminum alloy, copper, or a copper alloy.

The cooling guide 40 may have a substantially arc-shaped horizontal cross-section. The cooling guide 40 may be open forward, so a portion of the storage compartment 32 may also be open forward, but the insulating panel 42 to be described below may be coupled to the front of the storage compartment 32, so the storage compartment 32 may be closed. Alternatively, the cooling guide 40 may have a circular horizontal cross-section or may have a polygonal horizontal cross-section, rather than an arc shape, to fully surround the storage compartment 32.

Figure 10:
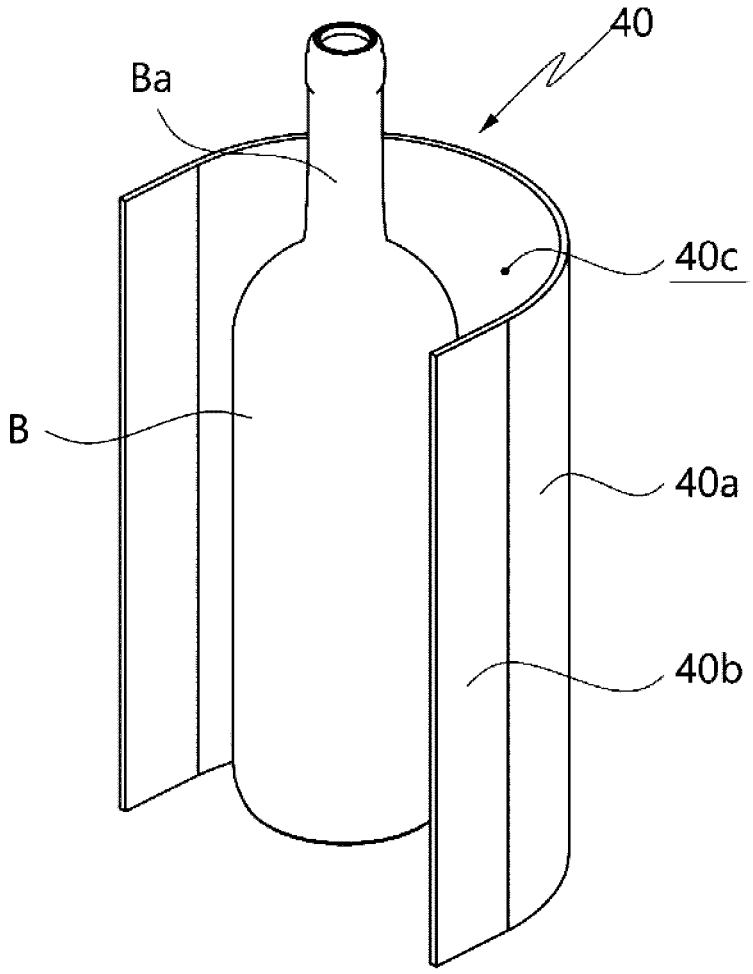
FIG. 10 is a perspective view showing the configuration of a cooling guide of the embodiment shown in FIG. 4.

In more detail, as shown in FIG. 10, the cooling guide 40 may include a first guide 40*a* and a second guide 40*b*. The cooler 50 may be connected to the first guide 40*a* and the first guide 40*a* may form the rear of a cooling space 40*c* defined by the cooling guide 40. The cooling space 40*c*, which is a space surrounded by the cooling guide 40, may be considered as a portion of the storage compartment 32. The cooling space 40*c* itself may not be a closed space, but may be a portion of the storage compartment 32, so it may be a closed space when the storage compartment 32 is closed.

The second guide 40*b* may be connected to the first guide 40*a* and may extend toward the front surface of the cabinet 10, that is, toward the insulating panel 42. The second guide 40*b* may surround both sides of the cooling space 40*c*. Obviously, the first guide 40*a* and the second guide 40*b* may be integrally formed in the embodiment, but may be discriminated in this way in terms of the shape and position.

In the embodiment, the first guide 40*a* of the cooling guide 40 may have a polygonal horizontal cross-section rather than an arc shape and may vertically extend in a uniform shape. That is, the cooling guide 40 surrounding the cooling space 40*c* may have a vertically uniform horizontal cross-sectional shape. Accordingly, temperature may be uniformly distributed throughout the entire cooling guide 40, thereby being able to prevent great temperature changes throughout the cooling guide 40.

The surface of the second guide 40*b* may be flat rather than curved. In the embodiment, the second guide 40*b* is a pair of flat structures and the second guides 40*b* may extend in parallel with each other at both ends of the first guides 40*a*, thereby defining the cooling space 40*c*.

The cooling guide 40 may have a height that can surround at least ½ or more of the drink container B in order to effectively cool the drink container B. Referring to FIG. 16, it can be seen that, in the embodiment, the height H1*a* of the cooling guide 40 is larger than the height of the other portion excepting the inlet Ba of the drink container B, that is, the height of the main body, so the cooling guide 40 surrounds most of the portion in which a drink is contained of the drink container B. The sum of the height H1*a* of the cooling guide 40 and the height H1*b* of the insertion guide 35 may be larger than the height of the entire drink container B.

Figure 15:
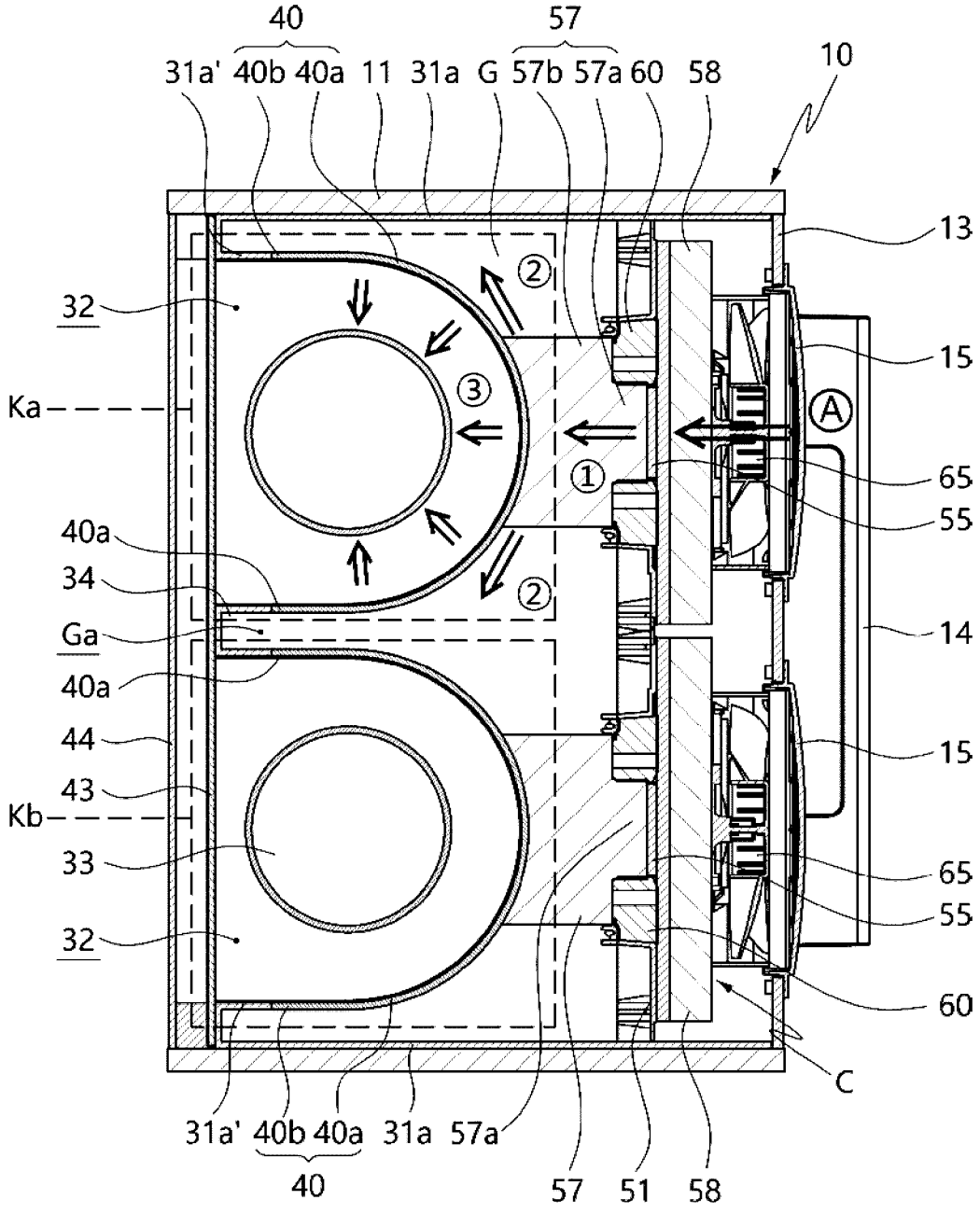
FIG. 15 is a cross-sectional view taken along line I-I' of FIG. 1.

In the embodiment, the end of the second guide 40*b* of the cooling guide 40 may be spaced apart from the insulating panel 42. Referring to FIG. 15, the end of the second guide 40*b* which faces the surface of the second panel 43 of the insulating panel 42 may be spaced apart from the second panel 43. The portion between the second panel 43 and the end of the second guide 40*b* may be filled with a portion of the inner frame 30 disposed in the installation space S, in more detail, the spacing portion 31*a*' of the side 31*a*.

Accordingly, it may be possible to prevent dew condensation on the insulating panel 40 due to the cooling guide 40 colder than the external air. That is, since the cooling guide 40 is not in direct contact with the insulating panel 42, it may be possible to prevent due condensation on the insulating panel 42 due to a temperature drop of the insulating panel 42 by the coldness of the cooling guide 40.

Although the inner case 30, 40 may be composed of the inner frame 30 and the cooling guide 40 in the embodiment, the inner case 30, 40 may be composed of only the cooling guide 40. That is, only the cooling guide 40 may function as the inner case 30, 40 without the inner frame 30.

Meanwhile, the front surface of the inner case 30,40 may be open, the storage compartment 32 may be open forward, and the open portions may be closed by the insulating panel 42. The insulating panel 42 may be disposed on the front surface of the inner case 30,40 opposite to the cooler C with the storage compartments 32 therebetween and may be made of an insulating material in a flat plate structure. The detailed structure of the insulating panel 42 will be described below.

The storage compartments 32 formed in the inner case 30, 40 may be separated as independent spaces by the cooling guides 40 coupled to the inner frame 40 and the insulating portion G surrounding the outer side of the insulating portion G. As described above, the storage compartment 32 may be defined by the inner case 30, 40, the insulating panel 42, and the cover assembly 90, and several independent storage compartments 32 may be formed.

Referring to FIG. 15, it can be seen that there are two different separate storage compartments 32. The two storage compartments 32 may be surrounded by separate inner cases 30, 40, respectively, with a gap therebetween. Reference characters 'Ka' and 'Kb' are provided to discriminate the two independent storage compartments 32.

In more detail, a partition insulation portion Ga may exist between two adjacent cooling guides 40. The insulating portion G may exist in other portions of the installation space S, but the partition insulation portion Ga may also be formed in the portion between the two storage compartments 32. Accordingly, it may be possible to prevent heat transfer between adjacent different cooling guides 40, whereby the storage compartments 32 may be independently further effectively cooled. The insulating portion G may be a foamed insulating portion such as polyurethane resin, or an insulating portion G that is a separate part may be inserted in the installation space S that is an empty space, or it may be an empty space.

The insulating portion G may be filled between the outer side of the cooling guide 40 and the inner surface of the cabinet 10. That is, when the insulating portion G is filled, the cooling guide 40 may serve to separate a space such that filling liquid does not enter the storage compartments 32 in cooperation with the insertion guide 35.

As for the insulating panel 42 forming a side of the insulating space, the insulating panel 42 may surround the storage compartments 32 together with the cooling guides 40 disposed inside the inner case 30, 40. More specifically, the cooling guides 40, the insulating panel 42, and the bottom 31*b* may form the storage compartments 32 and the tops of the storage compartments 32 may be selectively closed by the cover assemblies 90 and the door 24.

Figure 11:
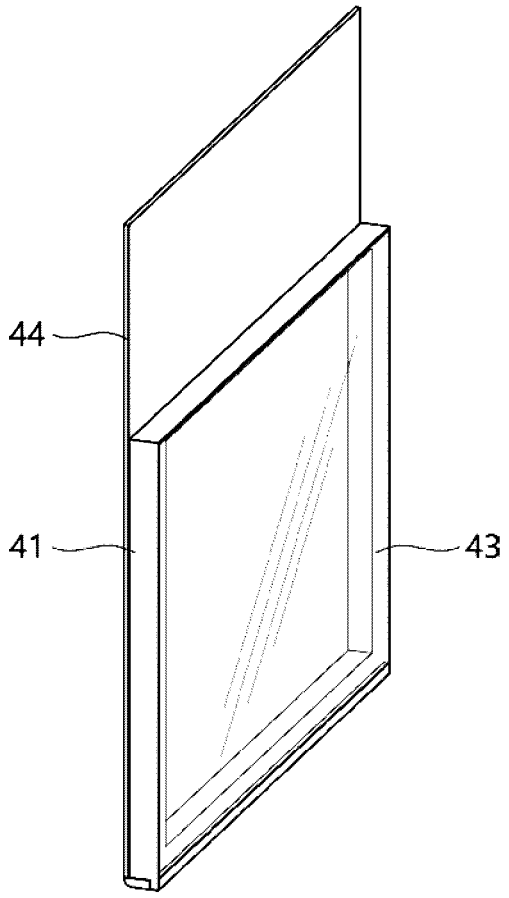
FIG. 11 is a perspective view showing the configuration of an insulating panel according to an embodiment of the present invention.
Figure 12:
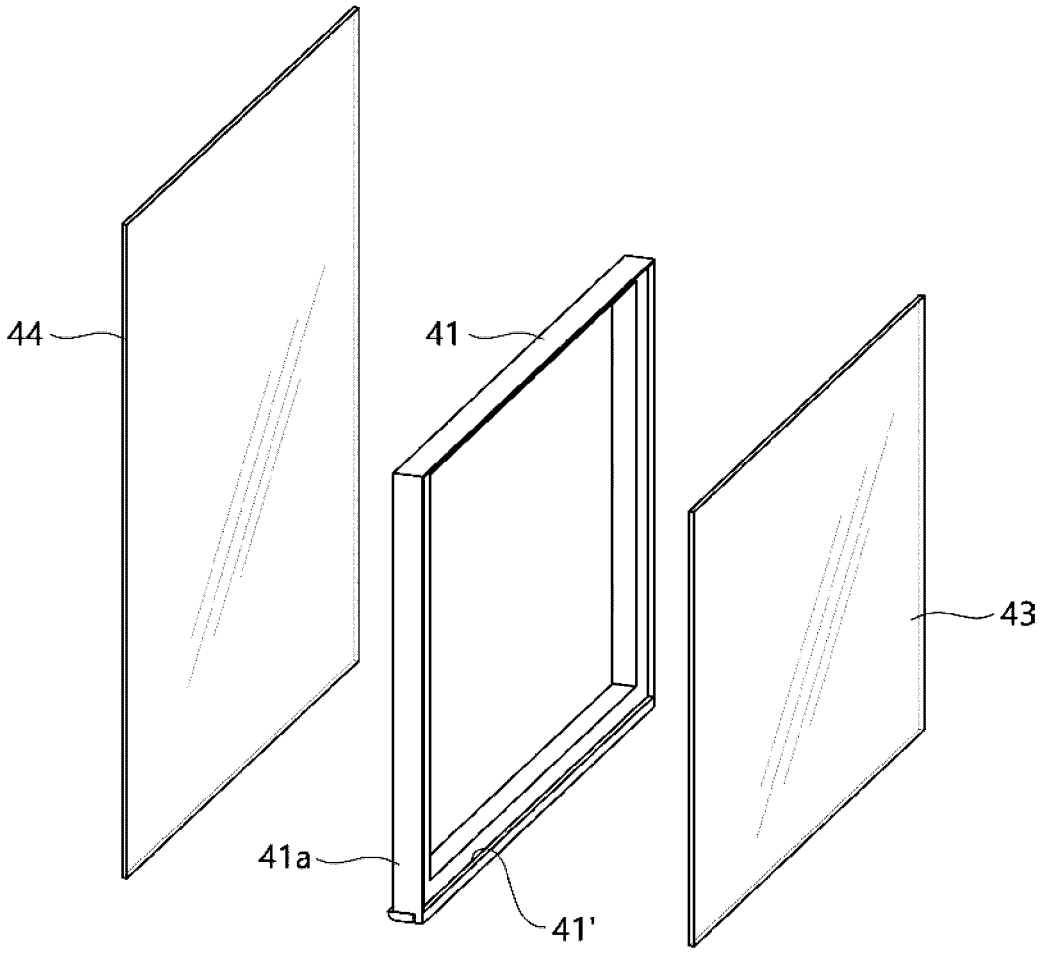
FIG. 12 is an exploded perspective view of the insulating panel shown in FIG. 11.
Figure 13:
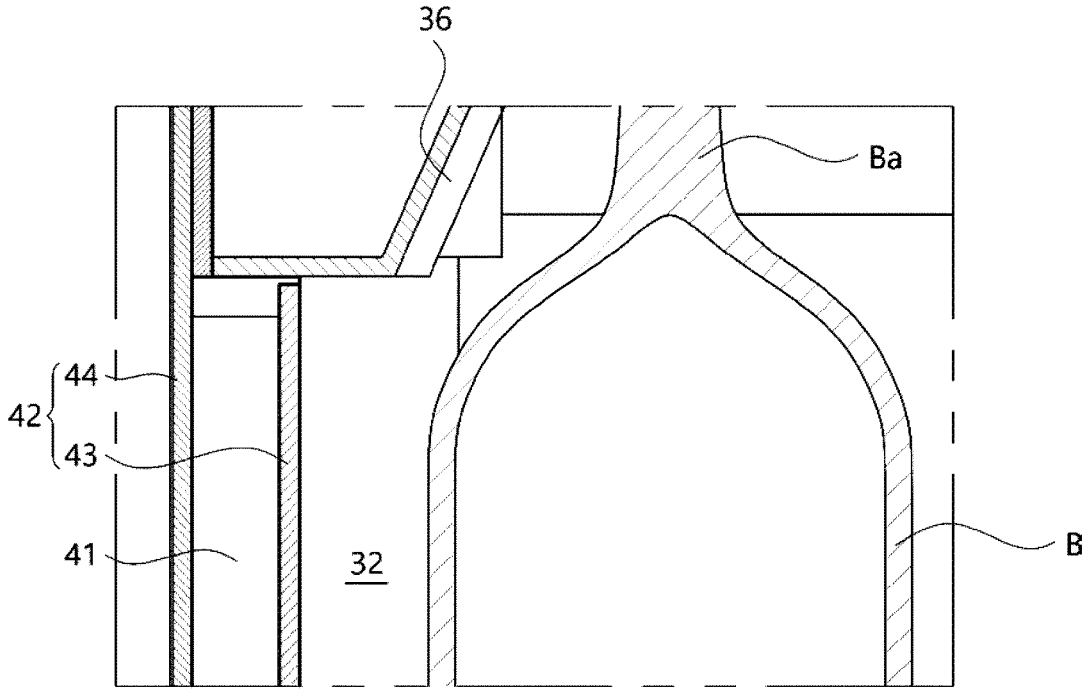
FIG. 13 is a cross-sectional view showing the configuration of an insulating panel and a storage compartment disposed inside the insulating panel in an embodiment of the present disclosure.

FIGS. 11 to 13 show the structure of the insulating panel 42. As shown in the figures, the insulating panel 42 may be composed of at least one or more pieces of insulating glass. In the embodiment, the insulating panel 42 may be composed of a first panel 43 and a second panel 44, which may be insulating glass. Accordingly, a user may see the storage compartments 32 through the first and second transparent panels 43 and 44 and may observe the drink containers B in the storage compartments 32. A user may recognize the kinds of the drinks in the storage compartments 32 through the insulating panel 42. An empty space may be defined between the first panel 43 and the second panel 44 and the empty space may be vacuum.

The first panel 43 and the second panel 44 of the insulating panel 42 may be mounted on an insulating frame 41. The insulating frame 41 may be mounted on the front edges of the inner case 30, 40, and the first panel 43 may be mounted on the insulating frame 41 in the embodiment. The second panel 44 may be directly coupled to the front surface of the inner case 30, 40.

More specifically, the first panel 43 may be fixed to a side of the insulating frame 41 and a side of the first panel 43 may face the storage compartments 32 and close the fronts of the storage compartments 32. The first panel 43 may be held and fixed on a mount 41' stepped on a side of the insulating frame 41.

The second panel 44 may be disposed on the front surface 41*a* of the insulating frame 41. The second panel 44 may be fixed to the outer front surface 41*a* of the insulating frame 41 at a predetermined distance from the first panel 43, and may form the front surface of the cabinet 10. The space between the first panel 43 and the second panel 44 may be a vacuum for insulation. Obviously, alternatively, the insulating panel 42 may be only one layer or may be composed of three or more layers.

As shown in FIG. 11, the first panel 43 and the second panel 44 may be stacked so as not to at least partially overlap each other. More specifically, the second panel 44 may be larger than the first panel 43, so the second panel 44 may further protrude than the first panel 43.

Referring to FIG. 1, a front panel 80 and a display 83 to be described below may be disposed behind the portion, which does not overlap the first panel 43, of the second panel 44. In more detail, the mount space 36*a* may be formed behind the portion where the second panel 44 and the first panel 43 do not overlap each other, and the front panel 80 or the display 83 may be installed in the mount space 36*a*. The front panel 80 may be an operation panel that may sense input from a user by a touch, etc.

As described above, when the second panel 44 made of glass covers the front of the front panel 80, the entire front surface of the refrigerator may be glass and the front panel 80 may be protected by the second panel 44. Since there is no door on the front surface of the refrigerator in the embodiment, parts such as a gasket and a hinge may not be provided and a glass panel may be applied to the entire front surface. Accordingly, the area showing the inside of the storage compartments 32 may be increased and the front design that is exposed most to a user may be aesthetic.

Next, the cooler C is described hereafter. The cooler C may be disposed in the installation space S to reduce the temperature of the storage compartment 32. When the temperature of the storage compartment 32 decreases, the temperature of the drink container B in the storage compartment 32 may also decrease. In the embodiment, the cooler C may be at least partially in contact with the inner case 30, 40 surrounding the storage compartments 32, whereby cooling performance may be increased.

The cooler C may be disposed close to the storage compartment 32 to decrease the temperature of the storage compartment 32. The cooler C may be disposed at various positions except for the portion between the storage compartment 32 and the insulating panel 42. For example, the cooler C may be disposed at the left or right side of the storage compartment 32 or may be disposed behind the storage compartment 32.

As shown in FIG. 4, the cooler C may be disposed behind the storage compartment 32 opposite to the insulating panel 42. When the cooler C is disposed behind the storage compartment 32, one side of the cooler C may face the intake grille 15 and the discharge grille 16 of the rear plate 13, whereby cooling efficiency may be increased. Further, in the embodiment, since the widest installation space S may be secured behind the storage compartment 32, it may be easy to install the cooler C.

Several coolers C may be provided. More specifically, the number of the coolers C may be the same as the number of the storage compartments 32, and since two storage compartments 32 may be provided in the embodiment, two coolers C may be provided. The several coolers C may serve to separately decrease the temperature of the corresponding storage compartments 32. Accordingly, the internal temperatures of the several storage compartments 32 may be set at different levels, so the storage compartments 32 may be independently cooled. Obviously, if there are only one inner frame 30 and one storage compartment 32, only one cooler C may be provided.

Referring to FIGS. 15 and 16, cold air generated by the cooler C may flow toward the cooling guide 40 (in the direction of the arrow (1) and may cool the entire cooling guide 40 while flowing on the surface of the cooling guide 40 (in the direction of the arrow (2)). Further, the cooled cooling guide 40 may provide the cold air to the storage compartment 32 (in the direction of the arrow (3). Accordingly, the storage compartment 32 may be cooled.

As for the configuration of the cooler C, the cooler C may include a thermoelectric element 55 and the thermoelectric element 55 may keep the temperature of the storage compartment 32 low using the Peltier effect. The cooler C may have a structure connecting a low-temperature portion of the thermoelectric element 55 to the storage compartment 32 and discharging heat from a high-temperature portion to effectively cool the storage compartment 32.

Figure 14:
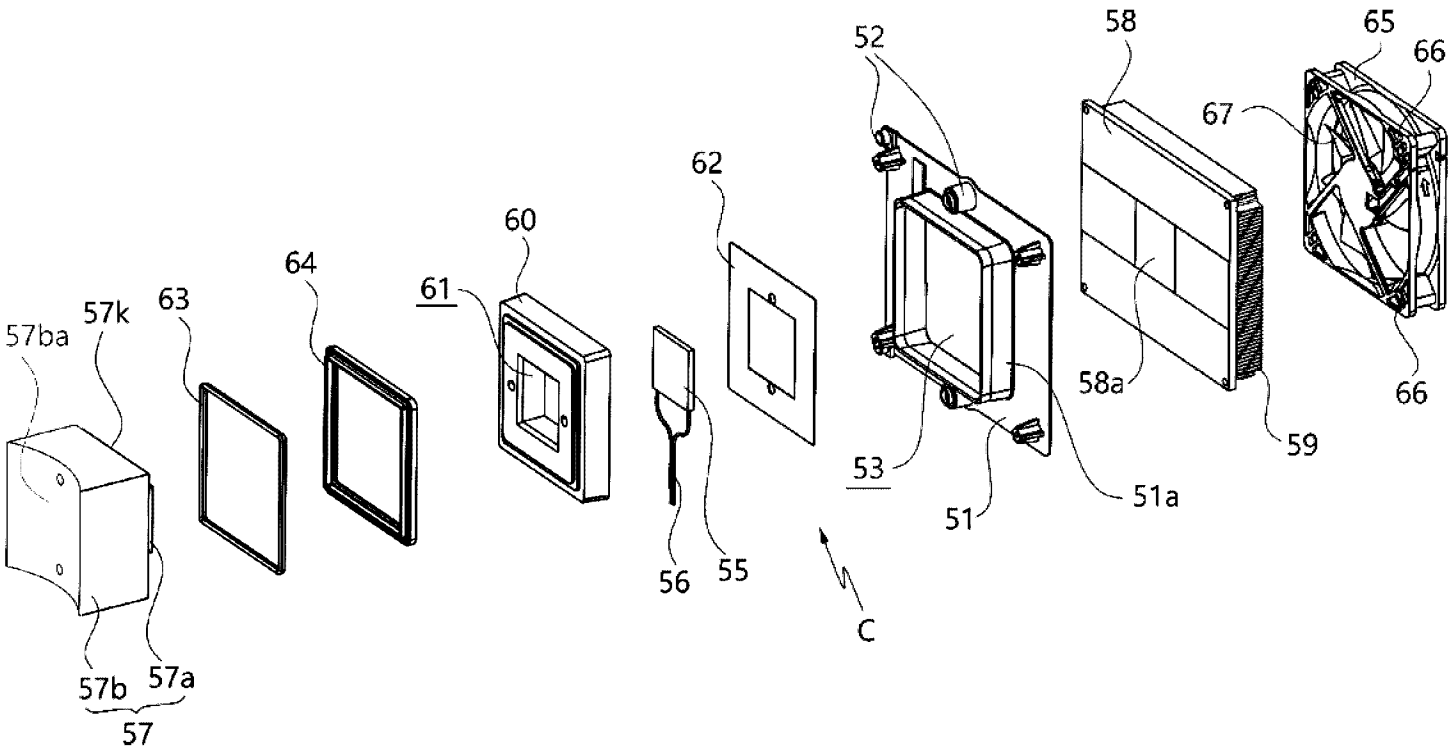
FIG. 14 is an exploded perspective view showing a cooler of the parts of the embodiment shown in FIG. 4.

In detail, referring to FIG. 14, the cooler C may be formed by assembling several parts. The cooler C may include an element housing 51 and the element housing 51 may form the frame of the cooler C. The element housing 51 may be a kind of rectangular frame and a receiving space 53 may be formed through the center of the element housing 51. Several parts including the thermoelectric element 55 may be disposed in the receiving space 53. The receiving space 53 may be defined inside a frame portion 51*a* protruding toward the thermoelectric element 55 from the element housing 51.

The element housing 51 may be made of a material that can minimize a loss of heat due to thermal conduction. For example, the element housing 51 may be made of a non-metallic material such as plastic. The element housing 51 may serve to prevent heat of a heat sink 58 from transferring to a cooling block 57 in cooperation with an insulating frame 60 to be described below. Reference numeral '52' indicates several fastening bosses for fixing the element housing 51, and some of the fastening bosses may couple other parts to the element housing 51.

The thermoelectric element 55 may be disposed in the receiving space 53. The thermoelectric element 55 may have a low-temperature portion and a high-temperature portion, and the low-temperature portion and the high-temperature portion may be determined in accordance with the direction of a voltage that is applied to the thermoelectric element 55. The low-temperature portion of the thermoelectric element 55 may be positioned closer to the cooling guide 40 than the high-temperature portion. The low-temperature portion may be in contact with the cooling block 57 to be described below and the high-temperature portion may be in contact with the heat sink 58. The cooling block 57 may cool the cooling guide 40 and heat may be dissipated from the heat sink 58. Reference numeral '56' indicates a cable for applying power to the thermoelectric element 55.

The cooling block 57 may be in contact with the thermoelectric element 55. The cooling block 57 may be disposed between the thermoelectric element 55 and the cooling guide 40 with one side in contact with the cooling block 57 and the opposite side in contact with the cooling guide 40. Accordingly, the cooling block 57 may transmit the coldness of the low-temperature portion of the thermoelectric element 55 to the cooling guide 40.

The cooling block 57 has a substantially hexahedral 3D shape. In both sides of the cooling block 57, a first surface 57*aa* (see FIG. 17) that is a surface facing the thermoelectric element 55 and a second surface 57*ba* that is a surface facing the cooling guide 40 may have different areas. In the embodiment, the second surface 57*ba* is wider than the first surface 57*aa*. Accordingly, coldness of the thermoelectric element 55 may be transmitted to the wide area of the cooling guide 40. Further, since the first surface 57*aa* being in contact with the thermoelectric element 55 may be relatively small, space usability may be increased.

On the contrary, the second surface 57*ba* may be smaller in area than the first surface 57*aa*. In this case, a larger thermoelectric element 55 may be connected to the relatively wide first surface 57*aa* or several thermoelectric elements 55 may be in contact with the first surface 57*aa*, and the cooling guide 40 may be quickly cooled.

In the embodiment, the first surface 57*aa* of the cooling block 57 may be in direct contact with the thermoelectric element 55 and the second surface 57*ba* that is the opposite surface of the cooling block 57 may be in direct contact with the cooling guide 40. Alternatively, a separate medium may exist at any one of between the first surface 57*aa* and the thermoelectric element 55 or the second surface 57*ba* and the cooling guide 40. The medium may be made of a material with high thermal conductivity.

Meanwhile, the first surface 57*aa* that is the surface being in contact with the thermoelectric element 55 of the cooling block 57 and the second surface that is the surface facing the cooling guide 40 of the cooling block 57 may have different shapes. In the embodiment, the second surface 57*ba* facing the cooling guide 40 of the cooling block 57 may be curved, but the first surface 57*aa* facing the thermoelectric element 55 of the cooling block 57 may be flat. As described above, the first surface 57*aa* and the second surface 57*ba* may be formed to fit to the surface shapes of the contact objects (the thermoelectric element 55 and the cooling guide 57), respectively, the contact areas with the objects may be increased. Obviously, if the surface of the cooling guide 40 is flat, the surface of the cooling block 57 may also be flat and the first surface 57*aa* may also be curved rather than flat.

In the embodiment, the cooling block 57 may include a first block 57*a* being in contact with the thermoelectric element 55 and a second block 57*b* being in contact with the cooling guide 40. The first block 57*a* and the second block 57*b* may have different shapes with a stepped surface 57*k* therebetween. The first block 57*a* and the second block 57*b* may be integrated or may be separate parts.

The first block 57*a* may be a substantially rectangular parallelepiped and the second block 57*b* may have a smaller cross-sectional area. The second block 57*b* may also be substantially a hexahedron, but the second surface 57*ba* facing the cooling guide 40 is a curved surface.

The first block 57*a* may protrude from the cooling block 57 toward the receiving space 53 of the element housing 51.

The first block 57*a* is a rectangle when seen from the front. The first surface 57*aa* that is a surface of the first block 57*a* may be in close contact with the thermoelectric element 55. The first block 57*a* may press the thermoelectric element 55 toward the heat sink 58, whereby the thermoelectric element 55 may be fixed between the first block 57*a* and the heat sink 58.

Figure 17:
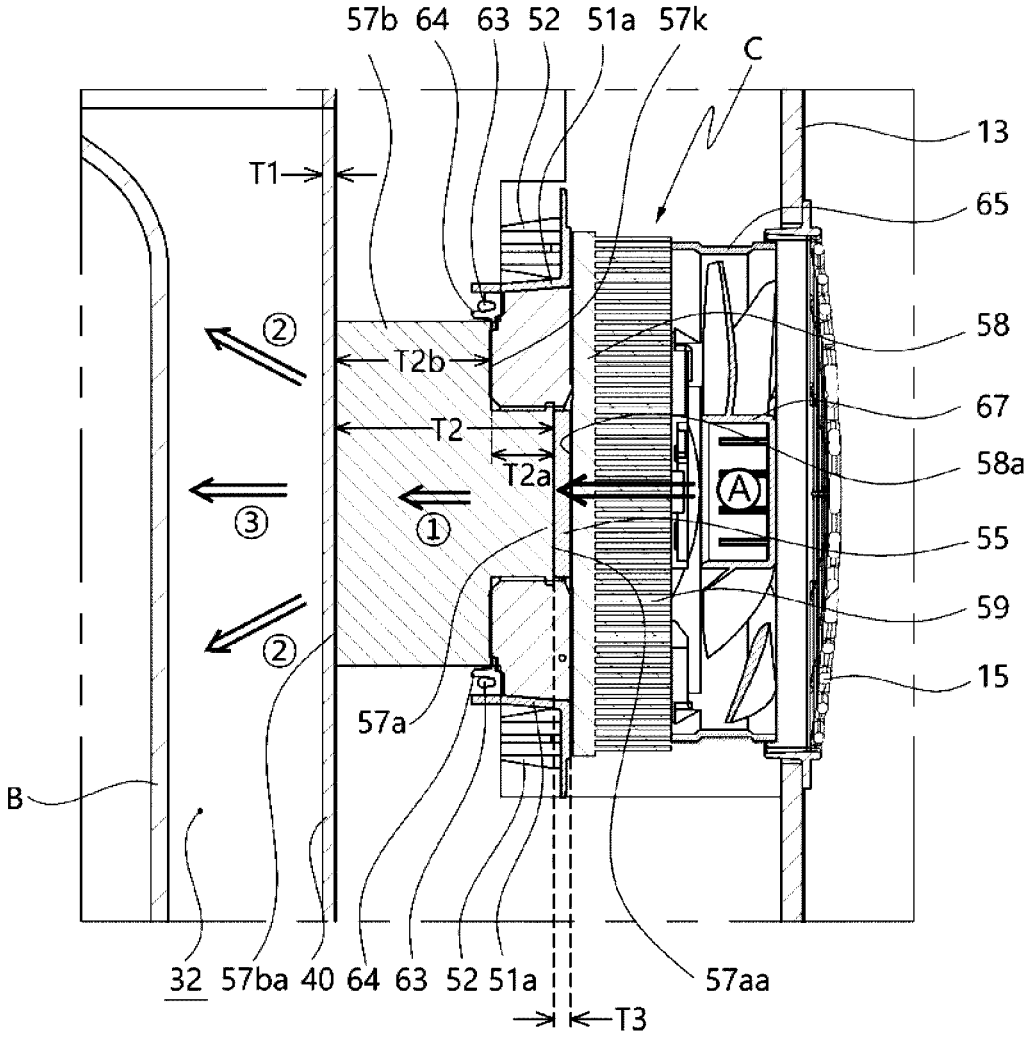
FIG. 17 is an enlarged cross-sectional view showing an embodiment of a cooler of a refrigerator for drinks according to the present disclosure.

As shown in FIG. 17, the thickness T2 of the entire cooling block 57 may be larger than the thickness T1 of the cooling guide 40. For reference, the thickness may be the front-rear width of the cabinet 10. Accordingly, an insulating portion G having a sufficient thickness and height may be secured around the cooling block 57, so the insulating performance of the refrigerator may be increased.

Further, when the thickness T2 of the cooling block 57 is larger than the thickness T1 of the cooling guide 40, the cooling block 57 may secure a sufficient distance between the cooling guide 40 and the thermoelectric element 55, so the temperature difference between the two regions may be maintained at a predetermined level or higher. Reference numeral 'T3' not stated is the thickness of the thermoelectric element 55 and the thickness T3 of the thermoelectric element 55 may be variously set.

In the embodiment, the thickness T2*b* of the second block 57*b* may be larger than the thickness T2*a* of the first block 57*a*. The cross-sectional area of the second block 57*b* may be larger than the cross-sectional area of the first block 57*a* and the second block 57 may be thicker than the first block. As described above, when the second block 57*b* is relatively thick, the cooling block 57 may secure a sufficient distance between the cooling guide 40 and the thermoelectric element 55 and it is advantageous in terms of maintaining the temperature difference between the two regions at a predetermined level or higher using the larger cross-sectional area of the second block 57*b*.

Referring to FIG. 16, the height H2 of the cooling block may be smaller than the height H1*a* of the cooling guide. The larger the height of the cooling block 57, the smaller the area a occupied by the insulating portion G and the lower the insulating efficiency. Accordingly, in the embodiment, the height H1*a* of the cooling guide may be relatively large. Accordingly, the height of the insulating portion G surrounding the cooling block 57 may be large. For reference, the installation space S is an empty space in FIG. 16, but the installation space S may be filled with the insulating portion G.

Figure 18:
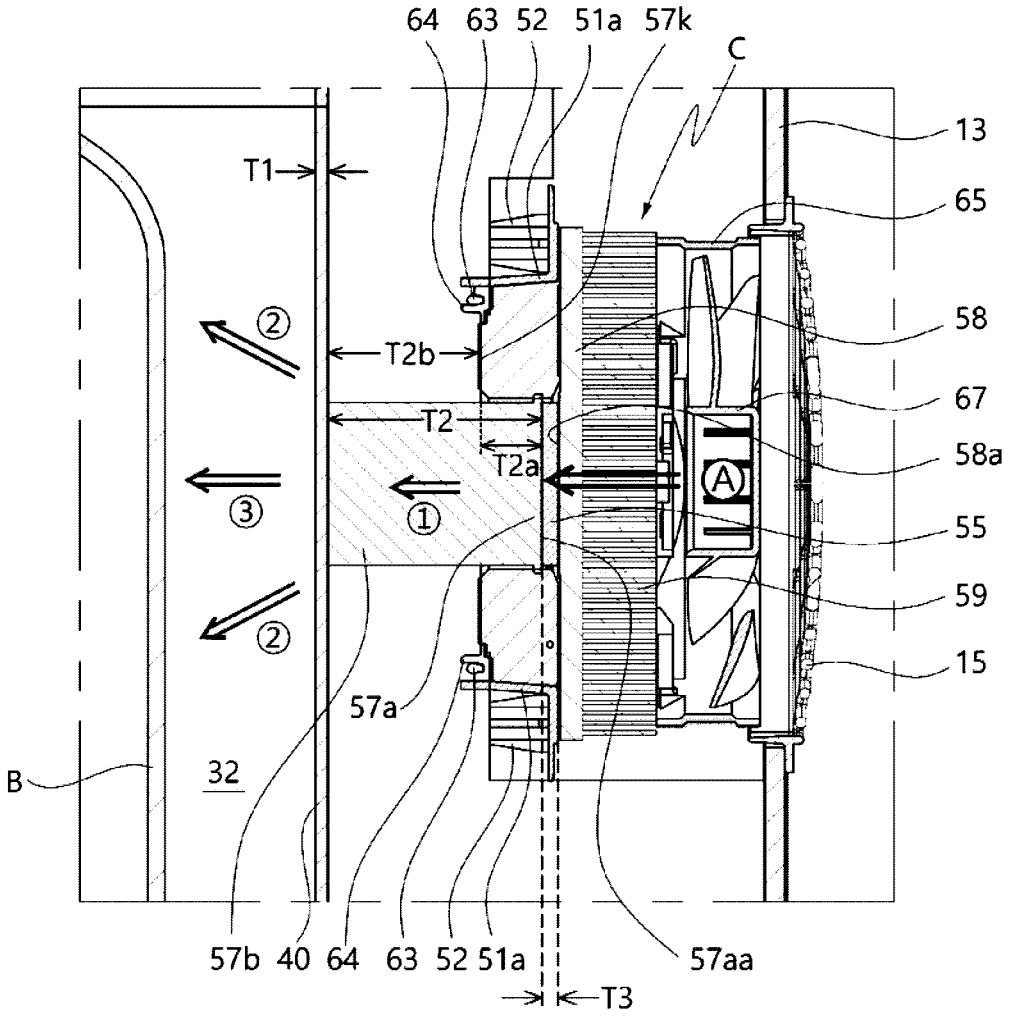
FIG. 18 is an enlarged cross-sectional view showing another embodiment of the cooler of a refrigerator for drinks according to the present disclosure.

FIG. 18 shows another structure of the cooling block 57. As shown in the embodiment of FIG. 18, the first block 57*a* and the second block 57*b* of the cooling block 57 may have the same cross-sectional area without a stepped portion. That is, the cooling block 57 may be substantially a rectangular parallelepiped or a polyprism or a circular cylinder.

However, even in this case, the shapes and areas of the first surface 57*aa* of the first block 57*a* and the second surface (not given reference number) of the second block 57*b* may be different from each other. Since the second surface may be in close contact with the cooling guide 40 having a curved shape, the second surface is curved. The first surface 57*aa* may be flat to be in surface contact with the surface of the thermoelectric element 55.

Meanwhile, the heat sink 58 may be disposed opposite to the cooling block 57 with the thermoelectric element 55 therebetween. The heat sink 58 may be in contact with the high-temperature portion of the thermoelectric element 55, thereby serving to dissipate heat of the high-temperature portion of the thermoelectric element 55. A heat dissipation fan 65 to be described below may be coupled to the heat sink 58, whereby the heat dissipation fan 65 may cool the heat sink 58.

As for the structure of the heat sink 58, the heat sink 58 may include a heat dissipation plate (not given reference numeral) and a plurality of heat dissipation fins 59. The heat dissipation fins 59 may be stacked with gaps therebetween. The heat dissipation plate may be a thin plate and may be in contact with the heat dissipation fins 59.

The heat dissipation plate may further include an element contact plate 58*a* for contact with the thermoelectric element 55. The area of the element contact plate 58*a* may be smaller than the area of the heat dissipation plate. For example, the element contact plate 58*a* may have a surface area that is substantially the same as the surface of the thermoelectric element 55. The element contact plate 58*a* may be exposed to the thermoelectric element 55 through the receiving space 53 of the element housing 51.

The cooler C may further include an insulating frame 60 surrounding the thermoelectric element 55. The thermoelectric element 55 may be positioned inside the insulating frame 60. The insulating frame 60 may have an element mount hole 61 open forward and rearward and the thermoelectric element 55 may be positioned in the element mount hole 61.

The front-rear thickness of the insulating frame 60 may be larger than the thickness of the thermoelectric element 55. The insulating frame 660 may serve to increase the efficiency of cooling the thermoelectric element 55 by preventing the heat of the thermoelectric element 55 from being conducted to the edge of the thermoelectric element 55. The edge of the thermoelectric element 55 may be surrounded by the insulating frame 60, whereby the heat transferring from the cooling block 57 to the heat sink 58 may not be dissipated around.

A back plate 62 may be disposed on the rear surface of the insulating frame 60. The back plate 62 may be combined with the insulating frame 60 to surround the edge of the thermoelectric element 55. The back plate 62, similar to the insulating frame 60, may serve to increase the efficiency of cooling the thermoelectric element 55 by preventing the heat of the thermoelectric element 55 from being conducted to the edge of the thermoelectric element 55. The back plate 62 may be positioned in the receiving space 53 of the element housing 51.

A gasket 63 may be disposed at the close contact portion between the insulating frame 60 and the cooling block 57. The gasket 63 may have an elastic material such as rubber. The gasket 63 may be formed in a rectangular ring shape, but is not limited thereto and the shape thereof may be changed in accordance with the shape of the insulating frame 60. The gasket 63 may function as a sealing member and may prevent heat from being dissipated between the insulating frame 60 and the cooling block 57. Reference numeral '64' indicates a holder for fixing the gasket 63.

The heat dissipation fan 65 may be coupled to the rear of the heat sink 58. The heat dissipation fan 65 may be disposed to face the heat sink 58 and may blow external air flowing inside through the air intake port to the heat sink 58. The heat dissipating fan 65 may include a fan 67 and a fan housing surrounding the outer side of the fan 67. The fan 67, for example, may be an axial fan. The fan 67 may be spaced apart from the heat sink 58. Accordingly, the flow resistance of the air blown by the heat dissipation fan 65 may be minimized and heat exchange efficiency at the heat sink 58 may be increased. The heat dissipation fan 65 may be fixed to the heat sink 58 by a fixing pin 66.

Referring to FIG. 15, the portion around the connection portion between the cooler C and the cooling guide 40 of the inner case 30, 40 may be filled with the insulating portion G. Accordingly, the insulating portion G may serve to increase the efficiency of cooling the thermoelectric element 55 by preventing the heat of the thermoelectric element 55 from being conducted to the edge of the thermoelectric element 55. As a result, the insulating frame 60 may primarily perform insulation by surrounding the edge of the thermoelectric element 55 and the insulating portion G may secondarily perform insulation by surrounding the edge of the cooler C.

Though not shown, a fuse may be connected to the thermoelectric element 55, so when overvoltage is applied to the thermoelectric element 55, the fuse may cut the voltage that is applied to the thermoelectric element 55.

Meanwhile, unlike the previous embodiment, the cooler C may cool the storage compartment 32 by discharging cold air into the storage compartment 32 without directly cooling the cooling guide 40. In this case, the cooling guide 40 may not be necessarily made of a metallic material having high thermal conductivity and may be integrated with the inner case 30, 40 or may not be provided.

Referring to FIGS. 4 and 16, the cabinet 10 may have a dispenser nozzle 70. The dispenser nozzle 70 may be a part that dispenses a drink from the drink container B in the storage compartment 32, and may be disposed on the front surface of the cabinet 10 in the embodiment. The same number of dispenser nozzles 70 as the number of storage compartments 32 may be provided, and two dispenser nozzles 70 may be provided in the embodiment. The dispenser nozzles 70 may be used to supply the drinks in the drink containers B in different storage compartments 32, respectively. Alternatively, all or some of the dispenser nozzles 70 may be disposed on a side of the cabinet 10.

The dispenser nozzle 70 may include a connection pipe 72 connected to the cabinet 10 and a dispenser head 71 connected to the connection pipe 72 and extending in the height direction of the refrigerator. An outlet 75 may be formed inside the dispenser head 71, so the drink in the drink container B may be supplied through the outlet 75. For reference, though not shown, when the internal pressure of the drink container B is increased by injecting air into the drink container B, the drink in the drink container B may be supplied outside through the connection pipe 72 and the outlet 75.

Tough not shown, when the internal pressure of the drink container B is increased by injecting air into the drink container B, the drink in the drink container B may be supplied outside through the connection pipe 72 and the outlet 75. To this end, an air pump may be installed in the installation space S and may increase the internal space of the drink container B through a gas supply pipe.

The dispenser nozzles 70 may be disposed on the insulating panel 42 at the front rather than on the top of the cabinet 10 in the embodiment. This may be possible because there may be no door on the front surface of the cabinet 10 and the front surface may be formed by the insulating panel 42. When the door 24 is disposed on the front surface of the cabinet 10, the door 24 may interfere with the dispenser nozzles 70 when it is opened and closed. However, since the door 24 may be disposed at the upper cover 20 rather than the front surface of the cabinet 10 in the embodiment, there may be no possibility of the dispenser nozzles 70 being interfered with when the door 24 is opened and closed.

More specifically, the connection pipe 72 of the dispenser nozzle 70 may be connected to the inside of the cabinet 10 through the front surface or a side of the cabinet 10. Accordingly, the connection nozzle 70 protrudes from the front surface of the side without being connected to the top of the cabinet 10, so the height of the entire refrigerator may be reduced. The front surface of the cabinet 10 may be the insulating panel 40 and the sides of the cabinet 10 may be the side plates 11 constituting the cabinet 10.

As shown in FIG. 16, the height of the connection pipe 72 may overlap the height of the insertion guide 35. The 'overlapping' may mean that the entire or a portion of the connection pipe 72 may overlap the height section of the insertion guide 35. In the embodiment, as described above, the connection pipe 72 may overlap the height of the insertion guide 35 that guides insertion of the drink container B. Since the insertion guide 35 guides insertion of the drink container B, it may be a part that has low direct relevance with cooling. Accordingly, leakage of coldness from the refrigerator through the connection pipe 72 may be minimized. Alternatively, when the connection pipe 72 has a height overlapping the cooling guide 40 performing a cooling function, coldness may leak from the refrigerator through the connection pipe 72, but, in the embodiment, the connection pipe 72 may not have a height overlapping the cooling guide 40.

Referring to FIG. 16, it can be seen that the dispenser nozzles 70 may be disposed within the height of the front surface of the cabinet 10 on which the insulating panel 42 is disposed. In other words, as described above, the dispenser nozzles 70 may be disposed to be at least partially included in the height section of the insulating panel 42 corresponding to the front surface of the cabinet 10 without being disposed on the top of the cabinet 10 or disposed to avoid the insulating panel 42.

In the embodiment, the dispenser nozzles 70 may be disposed on the portion, which does not overlap the first panel 43, of the second panel 44. The entire height section of the dispenser nozzles 70 may be included in the height section of the second panel 44. That is, an increase of the height of the front surface of the cabinet 10 due to the dispenser nozzles 70 may be prevented. Accordingly, the height of the entire refrigerator may be decreased as much as the height of the dispenser heads 72 in comparison to the case in which the dispenser nozzles 70 are disposed higher than the front surface while avoiding the front surface of the cabinet 10 (the insulating panel 42).

More specifically, at least a portion of the dispenser nozzle may have a height overlapping the mount space **36*a* of the cabinet 10 in which the display 83 or an operation panel is installed. Referring to FIG. 16, it can be seen that the connection pipe 72 of the dispenser nozzle 70 has a height overlapping the mount space 36*a*. Accordingly, there is no need for providing the refrigerator with a specific height section for installing the dispenser nozzle 70**.

The upper end of the dispenser nozzle 70 may have a height that is the same as or larger than the height of the top of the cabinet 10 and the lower end of the dispenser nozzle 70 may be disposed in the cabinet 10 and may have a height that is the same as or larger than the height of the upper end of the cooling guide 40 that is cooled by the cooler C.

Accordingly, the dispenser nozzle 70 may not be provided upward further than the cabinet 10, so the height of the refrigerator may be reduced. Further, the dispenser nozzle 70 may be prevented from covering the cooling guide 40 when seen from the front. Since the height of the cooling guide 40 may corresponding to the main body of the drink container B, if the lower end of the dispenser nozzle 70 is higher than the upper end of the cooling guide 40, the drink container B stored in the storage compartment 32 may be shown well.

Further, in the embodiment, the dispenser nozzle 70 may be disposed higher than the cooling block 50 of the cooler C. Referring to FIG. 16, it can be seen that the dispenser nozzle 70 is disposed higher than the cooling block 50 and positioned at the upper portion of the cabinet 10. Accordingly, the dispenser nozzle 70 may be disposed at an upper portion where a drink may be easily supplied and dispensed. Further, the cooling block 50 may be disposed at a lower portion spaced apart from the open hole 22 that may come in contact with external air a lot, so it may be advantageous in terms of insulation.

On the other hand, a front panel 80 may be disposed close to the dispenser nozzles 70 and a display 83 may be disposed on the front panel 80. The front panel 80 may be disposed at the upper portion on the front surface of the cabinet 10 and may have a flat plate shape. In the embodiment, the front panel 80 may be positioned inside the second panel 44 positioned relatively outside of the insulating panel 42 described above, but the second panel 44 may be vertically shorter than the front panel 80 and the other portion may be filled with the front panel 80.

The display 83 may be disposed on the front panel 80. The display 83 may provide the information of the refrigerator or may provide an interface for inputting instructions, and in the embodiment, the display 83 may be a type enabling touch input. Various items of information such as the temperatures of the storage compartments 32, the storage periods of the stored drinks, and the kinds of drinks may be displayed through the display 83. A user may input temperatures of the storage compartments 32, internal brightness, turning-on/off of the refrigerator, etc. through the display 83.

The display 83 may be installed in the mount space **36*a* described above. Referring to FIG. 16, the mount space 36*a* that may be an empty space may be positioned behind the front panel 80 and the display 83 may be installed in the mount space 36*a*. Obviously, not only the display 83, a circuit board and a wire harness for control may be installed in the mount space 36*a***.

The front panel 80 may be disposed at the same height as the dispenser nozzles 70. More specifically, through-holes (not shown) through which the connection pipes 72 of the dispenser nozzles 70 pass may be formed through the front panel 80, whereby the connection pipes 72 may be connected to the insides of the storage compartments 32 through the through-holes.

The inlet Ba of the drink container B may be fitted to the cover assembly 90 in an open state. The cover assembly 90 may serve to close the inlet Ba of the drink container B and to close the open hole 22 at the center of the upper cover 20.

When a user lifts the cover assembly 90, the drink container B fitted to the cover assembly 90 may also be taken out of the storage compartment 32, or a user may fit the drink container B to the cover assembly 90 and then may insert the drink container B into the storage compartment 32. Accordingly, the cover assembly 90 may function as a kind of handle.

As for the configuration of the cover assembly 90, the cover assembly 90 may have a cover plate 91 configured to close the open hole 22, and a pressing portion 93 extending downward from the cover plate 91 to have the inlet Ba of the drink container B fitted therein. A handle 95 may be rotatably coupled to the cover plate 91, so when the handle 95 is rotated upward, as shown in FIG. 3, a user may hold the handle.

The cover plate 91 may be formed to fit to the shape of the open hole 22 and may have a flat plate shape. As shown in FIG. 16, the pressing portion 93 of the cover plate 91 may protrude downward from the cover plate 91 and may be slightly inserted in the open hole 22, in detail, in the storage compartment 32. The inlet Ba of the drink container B may be fitted in the pressing portion 93, whereby it may be closed.

The handle 95 may be erected to move the drink container B fitted in the cover assembly 90, as shown in FIG. 3, but may be rotated to form a continuous plane with the cover plate 91 after the drink container B is stored in the storage compartment 32. That is, the handle 95 may be considered as a part of the cover plate 91. Though not shown, when the handle 95 is rotated upward, as shown in FIG. 3, a portion of the handle 95 may deform the pressing portion 93, whereby the inlet of a bottom may be strongly pressed and fixed in the pressing portion 93.

A drink supply pipe (not shown) may be disposed in the cover plate 91. The drink supply pipe may have one side that may be inserted in the drink container B and an opposite side connected to the dispenser nozzle 70, thereby serving to deliver the drink in the drink container B to the dispenser nozzle.

When a gas supply pipe (not shown) connected with an air pump other than the drink supply pipe is formed in the cover plate 91, the internal space of the drink container B may be increased by injecting gas into the internal space (empty space) of the drink container B through the gas supply pipe, or it may be possible to prevent oxidation of a drink by injecting an inert gas.

Referring to FIG. 15, as for the process of cooling the storage compartment 32, when power is supplied to the thermoelectric element 55, coldness generated at the low-temperature portion (the left side of the thermoelectric element 55 in the figure) may be transmitted to the cooling block 57 (in the direction of the arrow ①). Substantially, the cooling block 57 and the low-temperature portion of the thermoelectric element 55 exchange heat, but the transmission direction of coldness is shown.

When the temperature of the cooling block 57 decreases, the temperature of the entire cooling guide 40 being in contact with the cooling block 57 may decrease. Since the second surface 57*ba* facing the cooling guide 40 of the cooling block 57 may be curved, as described above, a contact area with the cooling guide 40 may be sufficiently secured, so heat may be effectively exchanged between the cooling guide 40 and the cooling block 57.

The temperature of the cooling guide 40 may decrease along the surface (in the direction of the arrow (2) and the cooling guide 40 may be made of a material having high thermal conductivity such as copper or aluminum, so the entire cooling guide 40 may be cooled. When the temperature of the cooling guide 40 decreases, the cooling guide 40 may cool the storage compartment 32 while exchanging heat with the air in the storage compartment 32.

Since the cooling guide 40 may surround at least a portion of the storage compartment 32 and may have a curved surface surrounding the surface of the drink container B, the cooling guide 40 may effectively transmit coldness to the surface of the drink container B (in the direction of the arrow (3). That is, the cooler C may not cool the entire space in the refrigerator, but may cool the cooling guide 40 itself surrounding the drink container B, so the efficiency of cooling the refrigerator may be improved.

Next, a process of dissipating heat from the cooler C is described with reference to FIG. 16. Air flowing inside through the air intake port of the intake grille 15 may be discharged to the heat sink 58 (in the direction of the arrow A) by the heat dissipation fan 65. When the external air is sent to the heat sink 58, the temperature of the heat sink 58 being in close contact of the with the high-temperature portion of the thermoelectric element 55 decreases. Since the heat sink 58 may have a plurality of heat dissipation fins 59, a very wide contact area with the external air may be secured.

The air heated by removing heat from the cooler C may be discharged out of the refrigerator (in the direction of the arrow B). More specifically, the air in the refrigerator may be discharged through the air discharge port of the discharge grille 16. In the embodiment, since the air discharge port may be formed at the upper portion of the rear plate 13, air may be discharged at the upper portion, but the air discharge port may be formed at the lower portion of the rear plate 13.

The spacer 14 of the rear plate 13 may keep a distance between the rear plate 13 and a wall, so air may smoothly flow inside and outside.

Meanwhile, in the embodiment, the refrigerator may have two storage compartments 32 and the cooler C may be individually installed for each of the storage compartments 32. The coolers C may be independently controlled. Accordingly, it may be possible to set different temperatures for the storage compartments 32, and for example, when a drink is wine, it may be possible to set an appropriate temperature in accordance with the kind such as the type of the wine. That is, a user may control the temperature of drinks in accordance with the features of the drinks or his/her taste.

Figure 19:
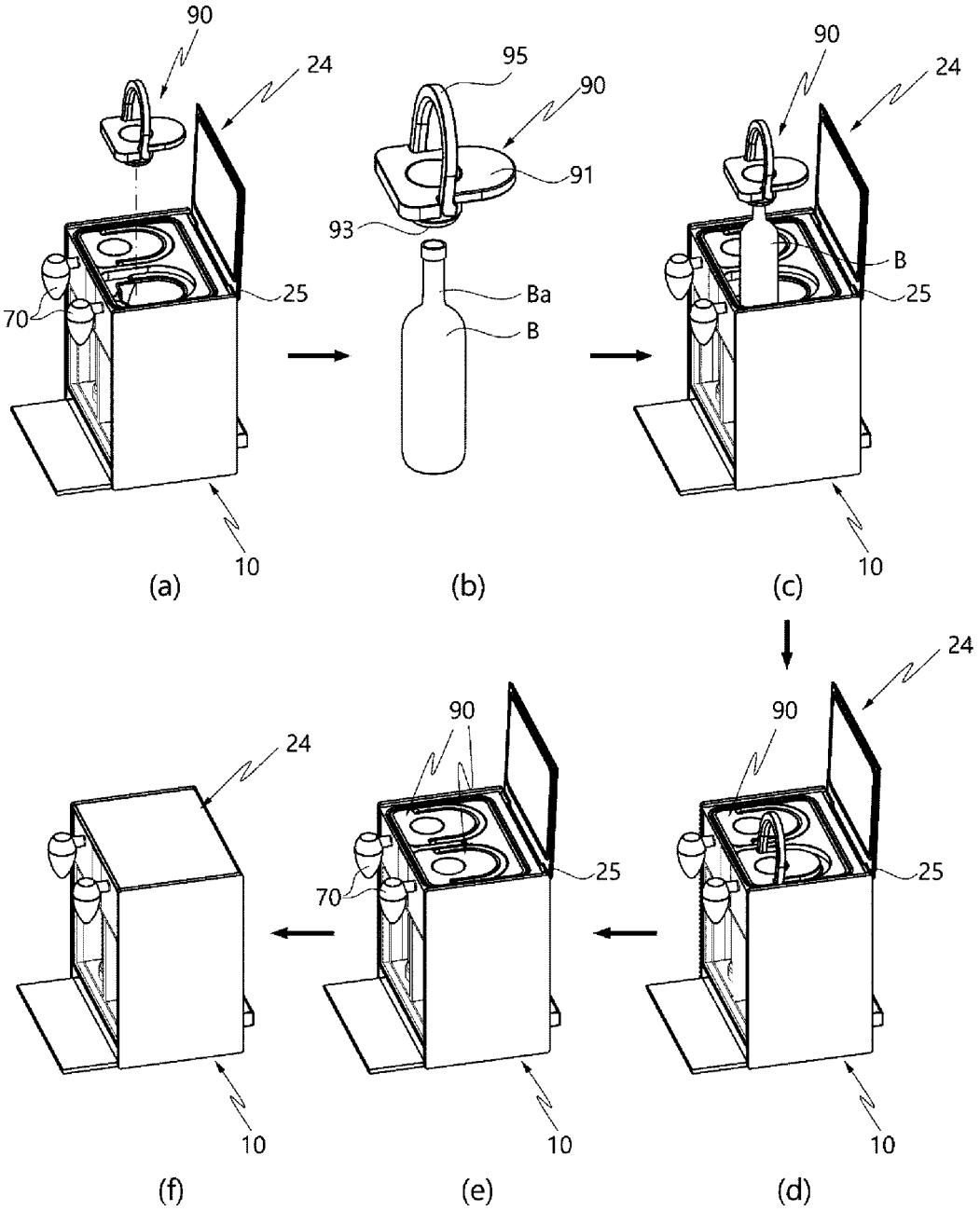
FIG. 19 sequentially shows a process of putting a drink container into a storage compartment using an embodiment of the present disclosure.

FIG. 19 sequentially shows a process of putting a drink container B into a storage compartment 32 of the refrigerator. As shown in (a) through (f) of the figure, a user may open first the cover 24 of the refrigerator and then may separate the cover assembly 90 closing the open hole 22. In this case, the cover assembly 90 closes the open hole 22 and the handle 95 has been rotated toward the upper cover 20, so a user first has to rotate the handle 95 away from the upper cover 20, that is, in the direction in which the handle 95 is erected.

When the handle 95 is erected, the user may separate the entire cover assembly 90 from the open hole 22 with the handle 95 by hand. This is shown in (a) of FIG. 19. When the cover assembly 90 is separated, the top of the storage compartment 32 may be exposed upward.

Although the storage compartment 32 is exposed to the outside, the exposed area may be limited within the area of the open hole 22. In the embodiment, since the open hole 22 is an entrance for the drink container B, the open hole 22 may be formed in a size such that the drink container B can be inserted, that is, in a size slightly larger than the width (diameter) of the drink container B. Accordingly, even though the open hole 22 that is an entrance is opened, the area through which the coldness in the storage compartment 32 leaks may be limited within the open hole 22, so a loss of heat due to leakage of coldness may be minimized.

Next, the user may couple the cover assembly 90 to the drink container B. The cap of the container B has been removed, so when the cover assembly 90 is fitted onto the inlet Ba of the drink container B, the pressing portion 93 of the cover assembly 90 may strongly fix the inlet Ba while surrounding the inlet Ba.

Accordingly, when the user lifts up the cover assembly 90, the drink container B may also be lifted. The user may hold the handle 95 of the cover assembly 90 and put the drink container B into the storage compartment 32 through the open hole 22 of the refrigerator. This is shown in (c) of FIG. 19. As described above, a user may take out or put the drink container B fitted in the cover assembly 90 from or into the storage compartment. Since the cover assembly 90 may function as a kind of handle, the drink container 32 that is heavy due to the drink therein may be easily put in and taken out.

As shown in (d) of FIG. 19, when the drink container B is inserted in the open hole 22, the cover assembly 90 may close the open hole 22. The cover assembly 90 itself may function as an internal door while closing the open hole 22. Accordingly, since the cover assembly 90 may close the storage compartment together with the door 24, the open hole 22 that is an entrance may be doubly insulated, whereby insulating effect may be increased.

Further, when the erected handle 95 is rotated to be laid down, the handle 95 may fill the cover seat 22' recessed around the open hole 22 of the upper cover 20. Referring to (d) of FIG. 19, the handle 95 may be rotated clockwise. The state in which the handle 95 has been rotated is clearly shown in (e) of FIG. 19.

Finally, when the user rotates and closes the door 24, the cover assembly 90 and the upper cover 20 may be closed. Since the door 24 may include the insulating plate 24*c*, the door 24 may also perform an insulating function as an external door.

When the drink container B is stored in the storage compartment 32, as described above, the drink container B and the dispenser nozzle 70 may be connected to each other. Accordingly, the user may be provided with the drink from the drink container 32 in the storage compartment 32 through the dispenser nozzle 70. The user may be provided with a drink through the dispenser nozzle 70 even without taking out the drink container B stored in the refrigerator for drinks. Accordingly, it may be possible to prevent a loss of heat that is always generated when the door 24 is opened to take out a drink container B.

Even if all components of the embodiments of the present disclosure were described as being combined in a single unit or operated in combination with each other, the present disclosure is not limited to the embodiments. That is, the all components may be selectively combined and operated within the scope of the present disclosure. Further, the terms "comprise", "include", "have", etc. when used in this specification mean that the components can exist inside unless specifically stated otherwise, so they should be construed as being able to further include other components. Unless otherwise defined, all terms including technical and scientific terms used herein have the same meaning as commonly understood by those skilled in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

What is claimed is:

1. A refrigerator, comprising:

a cabinet configured to store a drink container therein, the cabinet having a top with an opening through which the drink container is insertable;

a dispenser nozzle disposed to be at least partially exposed outside the cabinet, the dispenser nozzle being configured to supply the drink in the drink container to outside the cabinet;

a door located at the cabinet, the door being configured to open and close the opening of the cabinet;

an insertion guide located in the cabinet, the insertion guide communicating with the opening of the cabinet, the insertion guide having a width that changes in a height direction of the cabinet; and a cooler located in the cabinet, wherein the cabinet further includes a mount space in which a display, a front panel, or a circuit board is located, wherein the insertion guide is configured to surround an opening of the drink container, wherein at least a portion of the dispenser nozzle overlaps the insertion guide and the mount space at a same height in the height direction of the cabinet, respectively, wherein the mount space is between the rear of the insertion guide and the front of the dispenser nozzle, wherein a guide space is formed inside the insertion guide to connect the opening and the storage compartment, and wherein the surface of the insertion guide defines a portion of the mount space partitioned from the guide space.

2. The refrigerator of claim 1, wherein, in at least a portion of the insertion guide, the width of the insertion guide gradually increases towards the opening of the cabinet in the height direction of the cabinet.

3. The refrigerator of claim 1, wherein the refrigerator further comprises a forward panel, and wherein the insertion guide is configured to guide the drink container inserted through the opening of the cabinet toward the forward panel.

4. The refrigerator of claim 3, wherein the refrigerator further comprises an inner case located in the cabinet, the inner case defining at least a portion of a storage compartment configured to store the drink container therein, and wherein the insertion guide forms an inlet of the storage compartment.

5. The refrigerator of claim 1, wherein an inner case is located in the cabinet, the inner case including:

a pair of sides;

a bottom connected to the pair of sides; and the insertion guide connected to the pair of sides or the bottom, the insertion guide being in communication with the opening of the cabinet, and a cooling guide coupled between the bottom and the insertion guide.

6. The refrigerator of claim 5, wherein the cooling guide is connected to the insertion guide to define a continuous surface extending from the insertion guide to the bottom.

7. The refrigerator of claim 1, wherein the insertion guide has an expansion to define an inlet of the insertion guide, the expansion being inclined such that the inlet of the insertion guide widens from a lower portion of the insertion guide to an upper portion of the insertion guide.

8. The refrigerator of claim 7, wherein the expansion is inclined such that the inlet widens toward sides of the cabinet at left and right sides of the insertion guide and toward a rear plate of the cabinet behind the insertion guide.

9. The refrigerator of claim 7, further comprising an insulating portion provided at an exterior of the expansion.

10. The refrigerator of claim 1, wherein a front of the insertion guide and an inner surface of the cabinet are spaced apart from each other to define the mount space.

11. The refrigerator of claim 1, wherein the top of the cabinet includes an upper cover defining the opening of the cabinet, and wherein the refrigerator further comprises a cover assembly configured to surround an opening of the drink container, the cover assembly being couplable to the upper cover of the cabinet to selectively cover and uncover the opening of the cabinet or an inlet of the insertion guide.

12. The refrigerator of claim 1, wherein the insertion guide is provided in plurality, and wherein a partition wall is located between adjacent insertion guides.

13. The refrigerator of claim 1, wherein the dispenser nozzle includes a connection pipe connected to an inside of the cabinet, a portion of the connection pipe overlapping the insertion guide in the height direction of the cabinet.

14. The refrigerator of claim 1, wherein the refrigerator includes a cooling guide in the cabinet, the cooling guide being located between the drink container and the cooler, and wherein a lower end of the dispenser nozzle is located at a height that is the same as or higher than a height of the cooling guide.

15. The refrigerator of claim 1, wherein the cabinet further includes an insulating panel defining a front surface of the cabinet, at least a portion of the insulating panel being transparent, and wherein the dispenser nozzle protrudes from the insulating panel.

16. The refrigerator of claim 15, wherein the insulating panel includes:

a panel frame having a first surface facing the insertion guide and a second surface opposite the first surface;

a first panel fixed to the first surface of the panel frame; and a second panel fixed to the second surface of the panel frame to be spaced apart from the first panel, the second panel defining the front surface of the cabinet, the second panel being arranged such that a portion of the second panel does not overlap the first panel, and wherein the dispenser nozzle is connected to an inside of the cabinet through the portion of the second panel that does not overlap the first panel.

17. The refrigerator of claim 1, further comprising a bed protruding toward the opening from a bottom of the cabinet, the bed including:

an elevation body being movable up and down relative to the bottom of the cabinet; and an elastic member elastically supporting the elevation body on the bottom of the cabinet.

18. The refrigerator of claim 1, wherein the insertion guide is a single, one-piece member.

* * * * *